US007416111B1

(12) United States Patent
Kovacs et al.

(10) Patent No.: US 7,416,111 B1
(45) Date of Patent: Aug. 26, 2008

(54) CASH DISPENSING AUTOMATED BANKING MACHINE AND METHOD

(75) Inventors: Douglas A. Kovacs, North Canton, OH (US); Gary P. Babos, Louisville, OH (US); Kenneth Terra, Louisville, OH (US)

(73) Assignee: Diebold Self-Service Systems, division of Diebold, Incorporated, North Canton, OH (US)

( * ) Notice: Subject to any disclaimer, the term of this patent is extended or adjusted under 35 U.S.C. 154(b) by 477 days.

(21) Appl. No.: 11/074,429

(22) Filed: Mar. 7, 2005

Related U.S. Application Data

(60) Provisional application No. 60/551,958, filed on Mar. 9, 2004.

(51) Int. Cl.
*G07F 19/00* (2006.01)

(52) U.S. Cl. ..... 235/379; 235/488; 235/487

(58) Field of Classification Search ..... 235/487, 235/486, 379
See application file for complete search history.

(56) References Cited

U.S. PATENT DOCUMENTS 6,958,909 B2 * 10/2005 Endo et al. ..... 361/695

* cited by examiner

*Primary Examiner*—Karl D. Frech
(74) *Attorney, Agent, or Firm*—Ralph E. Jocke; Daniel D. Wasil; Walker & Jocke

(57) ABSTRACT

An ATM (10) includes a housing (12). Circuit card assemblies (256) used in the operation of the ATM are attached to a mounting plate (254). The mounting plate (254) can be releasably engaged to the housing (12). The mounting plate (254) includes integrally formed dimples (260) which facilitate the attachment and removal of the circuit card assemblies (256) therewith. The circuit card assemblies, while attached to the mounting plate, can be tested to ensure their proper operation prior to installation of the mounting plate in the ATM. The mounting plate and attached circuit card assemblies are configured to be suitable for use in various types and configurations of ATMs.

19 Claims, 34 Drawing Sheets

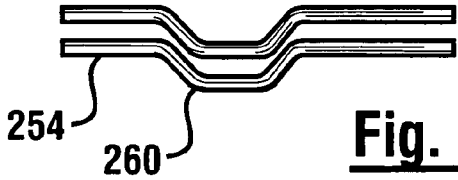
Fig. 36
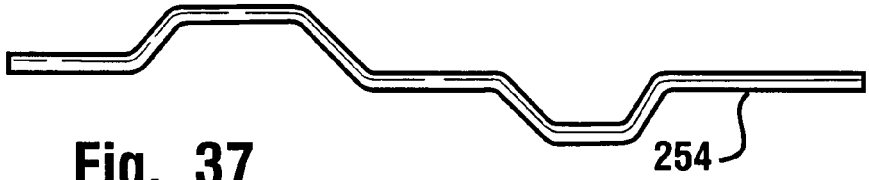
Fig. 37
Fig. 38
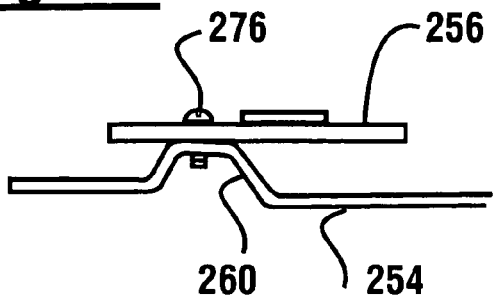
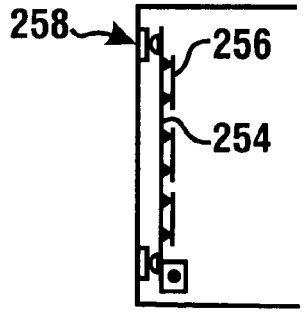
Fig. 39

CASH DISPENSING AUTOMATED BANKING MACHINE AND METHOD

CROSS REFERENCE TO RELATED APPLICATION

This application claims the benefit of U.S. Provisional Application No. 60/551,958 filed Mar. 9, 2004, and the disclosure thereof is incorporated herein by reference.

TECHNICAL FIELD

This invention relates to automated banking machines. Specifically, this invention relates to an automated banking machine that is more readily produced and serviced.

BACKGROUND ART

Automated banking machines are known in the prior art. A common type of automated banking machine used by consumers is an Automated Teller Machine ("ATM"). Customers of financial institutions may perform banking transactions, make inquiries concerning the status of their accounts, obtain cash, make deposits, pay bills, and obtain other banking services using automated teller machines. Typically the customer uses a magnetically encoded card that is inserted into the machine. The customer also inputs a personal identification number that allows the automated teller machine to verify the customer's identity. After the customer has conducted its transactions, the customer's card is returned along with one or more receipts which document the transactions conducted.

There are a number of different types of automated teller machines (ATMs). Some automated teller machines are designed to be inside the wall of a bank and have their customer interface extending through the wall of the bank. This enables customers to conduct their transactions without entering the bank either in a walk-up or drive-up fashion. This type of configuration is known as a "through-the-wall" configuration.

Other ATM units are designed to be freestanding either in the lobby of a bank or other commercial establishment. In these cases the entire ATM unit is placed on the floor and made operable by appropriate cabling. The lobby type ATMs have the advantage that they are much easier to install than a through-the-wall type machine.

In the past, some lobby ATM units and through-the-wall ATM units have been made specifically for the type of installation in which they will be used. This is because of the different environmental and security requirements for lobby and through-the-wall units. Although many of the components used in both types of units are the same, different components were necessary to meet the different operating conditions.

Another problem that has occurred with some prior machines is that when an ATM is installed within a facility, there must not only be room for the device, but there must also be provided sufficient area surrounding the machine for servicing. This is because ATMs require periodic replenishment of currency and supplies such as receipt forms, removal of customer deposits that have been deposited in the machine, and maintenance. To provide the necessary access for servicing, substantial space must be provided. This space is required to enable a service technician to swing open an access door and work on the components inside the ATM.

Significant space is also sometimes required for servicing an ATM because it is often unrealistic to service or repair components within the tight confines of the ATM enclosure. As a result, some components have been mounted on a chassis that can be slid out of the machine to better expose the components that require periodic servicing. Such chassis often occupy a substantial part of the overall width of the ATM enclosure. The service technician has generally been required to have access both behind and to the sides of the extended chassis to service the components thereon. As a result, in positioning the ATM provisions must be made to enable the technician not only to extend any components to their full servicing position but also to provide space for the technician to stand and move while conducting service operations.

The requirement of providing access space for servicing increases the amount of space required for an ATM installation. As a result, the housing for a through-the-wall ATM must often be larger than might otherwise be desired. Likewise, lobby unit ATMs cannot be generally mounted flush against a wall or in line with other self-service machines. This means that the lobby ATM must sometimes be generally free standing and requires surrounding unproductive floor space. In addition, the fact that persons could gain access to several sides of a lobby ATM unit increases the risk of attack by burglars as well as increases the opportunities for theft of the entire unit.

Automated banking machines also include electronic circuitry necessary for their operation. Generally such circuitry includes a plurality of circuit card assemblies, power supplies, switches, and other devices that are necessary to achieve operation of the machine. In the manufacture of automated banking machines, provision must be made for mounting circuit card assemblies and for routing wiring which interconnects circuit card assemblies to other circuit card assemblies and electrical devices within the machine. Generally because circuit card assemblies include a circuit board with electronic components mounted thereto, care must be taken to minimize the risk that improper electrical contact will be made with either side of the circuit card assembly. This is because conductive paths are generally exposed on each side of the card. In addition, it is often desirable to have circuit card assemblies disposed away from other surfaces so as to facilitate the dissipation of heat that may be generated by components on the card. Automated banking machine circuit card assemblies are generally mounted through fasteners that extend through the cards at the corners or in other areas where there are no electrical pathways. In addition, the surface of the card is generally offset from adjacent surfaces using appropriate spacers or other devices that will keep the conductive surfaces of the card disposed away from adjacent parts of the banking machine.

In the assembly of automated banking machines, generally circuit card assemblies and other devices must be mounted within the machine and then connected by appropriate wiring before the operation of such items in the use of the machine can be tested. If a problem is found after the items are installed, diagnosing the problem and removing the particular circuit card assembly that is malfunctioning can be more difficult. The same can also be true when malfunctions occur after the banking machine has been deployed. Conventional mounting of circuit card assemblies in ATMs can make it difficult to trouble shoot problems to identify malfunctioning items and to replace them.

A further drawback associated with some forms of banking machines is that the mounting of circuit card assemblies and other components is unique to the particular type of machine in which the components are mounted. Thus for example, a machine which is designed to be serviced from the front will have a different arrangement of circuit card assemblies and mounting within the machine compared to an ATM that is built to be serviced from the rear. This may further add cost to manufacturing processes and increase the complexity associated with testing and servicing the machines after they have been deployed.

DISCLOSURE OF INVENTION

Thus there exists a need for an automated banking machine that is more readily manufactured and serviced.

It is an object of an exemplary embodiment of the present invention to provide an automated banking machine that is more readily serviceable.

It is a further object of an exemplary form of the present invention to provide an automated banking machine that requires less space for installation and servicing.

It is a further object of an exemplary form of the present invention to provide an automated banking machine that is more readily manufactured.

It is a further object of an exemplary form of the present invention to provide an automated banking machine that provides better access for servicing of internal components.

It is a further object of an exemplary form of the present invention to provide an automated banking machine having an enclosure that can be configured for either front or rear access.

It is a further object of an exemplary form of the present invention to provide methods for making and servicing automated banking machines.

Further objects of exemplary forms of the present invention will be made apparent in the following Best Modes for Carrying Out Invention and the appended claims.

The foregoing objects are accomplished in an exemplary embodiment by an automated teller machine having a generally rectangular enclosure which includes a pair of spaced side walls and a top wall. The enclosure has a front opening and a rear opening. The front opening of the enclosure has associated therewith a fascia which includes the customer interface for operating the automated teller machine.

Transaction function devices and components comprising the automated teller machine are mounted in a pair of adjacent trays each of which can extend approximately one-half the width of the enclosure between the side walls. The trays are extendible individually out of one of the openings so that the components thereon may be serviced.

The exemplary ATM enclosure may be configured for use with either a space saving front access lobby type unit or a space saving through-the-wall unit. In the lobby unit, the front fascia is pivoted at the top and may be opened to provide access to the interior of the unit through a front opening. In this configuration, the back opening to the unit is permanently closed by a panel. The service technician servicing the lobby unit is enabled to stand on one side and extend the tray on the opposed side to service the components thereon. Thereafter, the technician may retract the extended back tray into the machine, move to the opposed side and extend the other tray.

To facilitate the technician's ability to work on the machine, the fascia panel includes an opening that normally provides viewing access to the screen, through which a technician can extend their head while servicing the components. As a result, the floor space for servicing the front access lobby unit is reduced. The machine may be positioned in tight quarters without impeding servicing.

In alternative installations such as a through-the-wall unit or where it is desirable to service the machine from the rear, the front fascia panel is permanently locked in place to close the front opening. The component trays are then arranged to extend from the rear of the machine which has a service door located thereon. The service door can be arranged to swing to the side or, alternatively, in an upward pivoting manner depending on the space constraints. A technician servicing the rear access machine is enabled to withdraw one of the trays from the enclosure at a time and stand on the opposed side to service the components on the extending tray. The technician may then retract the extending tray into the machine, move to that side and then extend the tray on the opposite side to work on those components.

The design of the exemplary ATM enclosure enables the technician to perform all the servicing functions while remaining in close proximity to the machine. As a result, the amount of space that must be provided around the ATM for servicing is minimized.

In an exemplary embodiment, the mounting of circuit card assemblies is facilitated by mounting circuit card assemblies on a formed mounting plate that is removable from the machine. The exemplary mounting plate includes projecting areas which extend outward from the generally planar surface of the plate, which areas are referred to in this disclosure as dimples. The exemplary dimples include apertures therein which can accept fasteners such as self threading screws.

The arrangement of the dimples on the mounting plate in the exemplary embodiment is such that a plurality of circuit card assemblies may be attached thereto by fasteners which hold the circuit card assemblies to the plates through the dimples. This results in the mounted circuit card assemblies generally having the sides thereof positioned so that the conductive areas thereon are disposed away from the plate to minimize the risk of shorting. Further, in the exemplary embodiment the mounting plates include openings, cutouts and other features that accommodate the desired arrangement of circuit card assemblies and other electrical components.

In exemplary embodiments, the mounting plate facilitates servicing and assembly of the machine. This is accomplished through methods which include during assembly, mounting the circuit card assemblies to the plate outside the machine housing and interconnecting the circuit card assemblies and other devices as appropriate through wiring. This enables testing of the interconnected circuit card assemblies for proper operation prior to placing the mounting plate in the machine. This can avoid difficulties associated with trouble shooting and replacement of specific circuit card assemblies after the machine has been assembled.

A further advantage in some embodiments is that the mounting plates may be made readily movable and/or removable from the housing of the machine. This may be done in some embodiments by having a limited number of quick-release fasteners or by installing the mounting plates in connection with slides, rollout trays, or other similar devices that enable the mounting plates to extend outside the machine. Further, in some exemplary embodiments the mounting plates can be constructed so that the same mounting plate may be used for machines that are serviced either from the front or from the rear. In exemplary embodiments, the various features of the mounting plate facilitate assembly and servicing of the machine.

BRIEF DESCRIPTION OF DRAWINGS

FIG. 36 is a partial side view of mounting plates showing how the plates may be stacked with the dimples in nested relation prior to circuit card assemblies being attached thereto.

FIG. 37 is a cross-sectional view of an exemplary mounting plate portion showing dimples that extend from both sides of the mounting plate.

FIG. 38 is a side view of a portion of the mounting plate with a circuit card assembly attached thereto.

FIG. 39 is an exemplary view of an ATM chest with the mounting plate attached thereto.

BEST MODE FOR CARRYING OUT INVENTION

Figure 1:
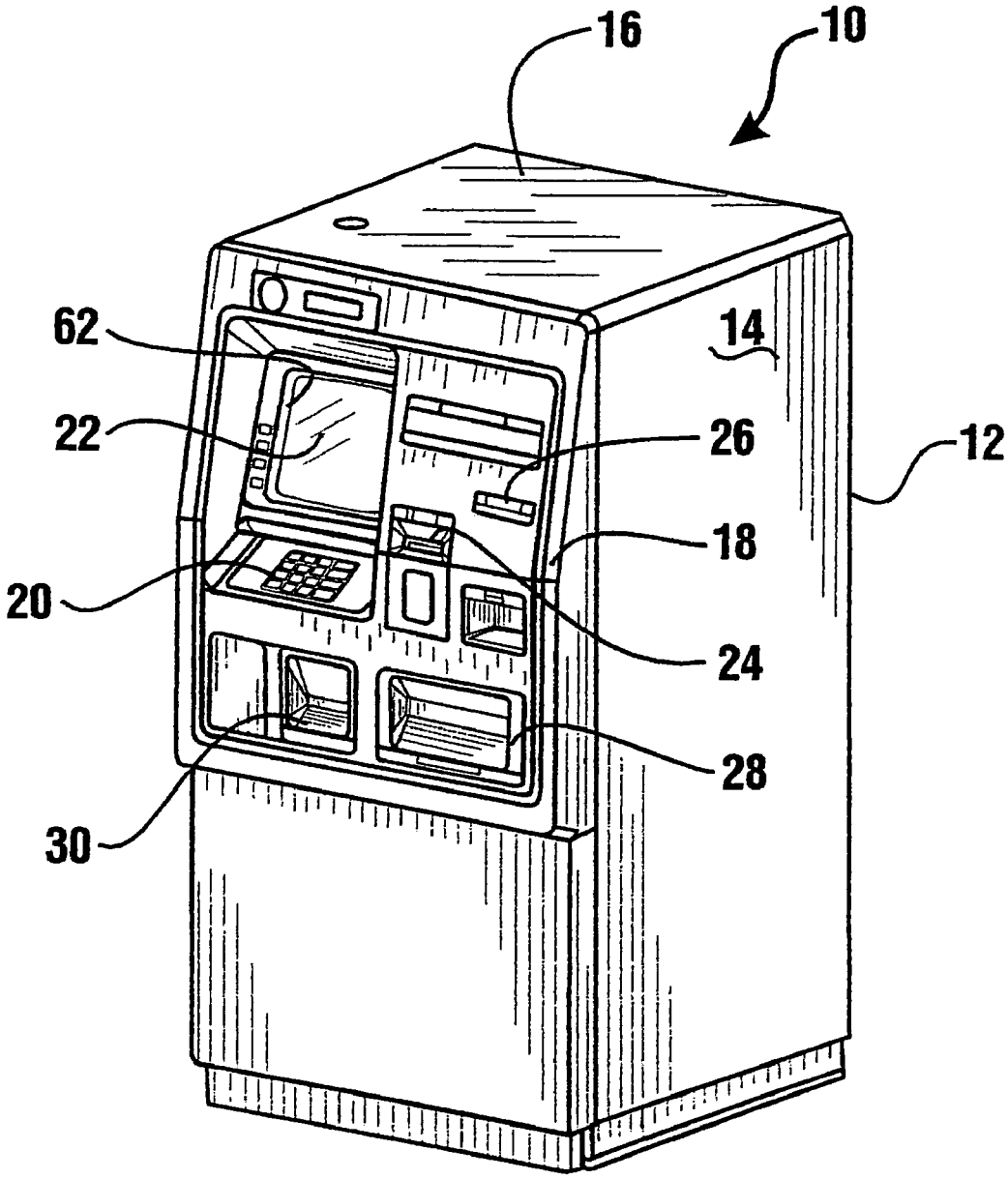
FIG. 1 is an isometric view of an exemplary automated teller machine designed for lobby use.

Referring now to the drawings and particularly to FIG. 1, there is shown therein an exemplary automated banking machine which comprises an automated teller machine generally indicated 10. The ATM has a housing also referred to as an enclosure 12 which includes a pair of spaced side walls 14 and a top wall 16. The ATM 10 further includes a front fascia panel 18 which includes the customer interface for the machine. Fascia panel 18 has extending thereon or accessible therethrough a keyboard 20, a monitor screen 22, a customer card accepting slot 24 and a receipt delivery opening 26. The ATM further includes a cash delivery door 28 as well as a deposit accepting opening 30. Of course, the fascia panel may have other openings and/or components accessible therethrough, such as a camera or a supply of depository envelopes.

The ATM 10 is a lobby installed unit which is freestanding within the confines of a bank, grocery store or other facility where customers may wish to conduct financial transactions.

Figure 6:
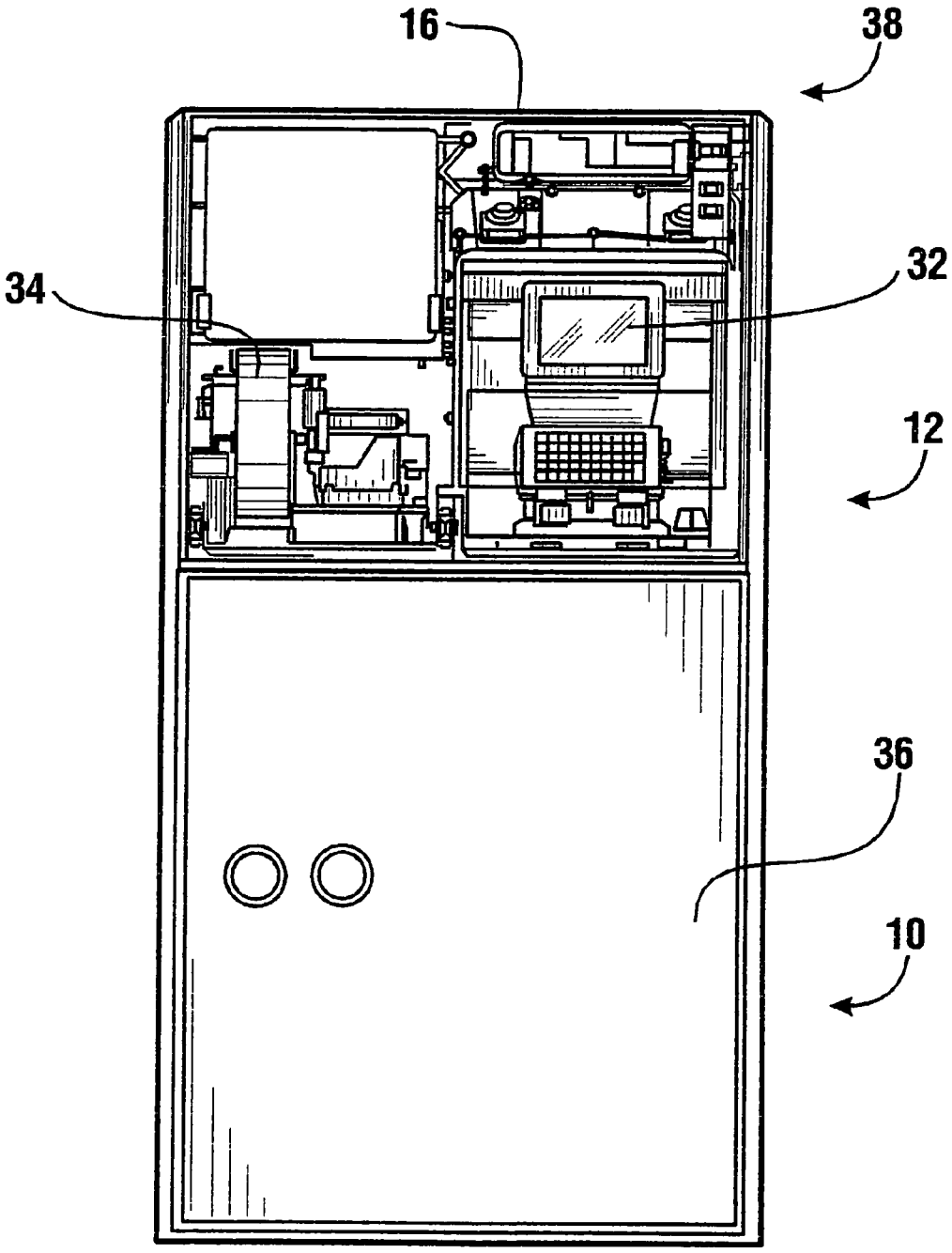
FIG. 6 is a back view of an automated teller machine with the rear opening of the enclosure open.

As best shown in FIG. 6, the enclosure 12 of the ATM has a plurality of components mounted in its upper portion. These include a monitor 32 and a receipt and journal printer assembly 34 which are mounted in the upper part of the assembly. Of course, other components are mounted therein as well including a card reader and an internal enclosure for holding cards that a customer has attempted to use which are invalid or which have been reported stolen. A lower portion of the enclosure 36 is a secure chest which houses a supply of currency to be dispensed from the machine and the currency dispensing mechanism. The chest also has an apparatus which accepts and stores deposits made by customers who use the machine. The chest has its own access door thereto, which is generally a high security door. In the type of lobby ATM machine shown in FIG. 1, the back opening 38 shown in FIG. 6 would normally be permanently covered by a closure panel so that the components therein would not be visible.

In an exemplary embodiment, the currency dispensing mechanism may be one of the types shown in U.S. Pat. No. 6,634,636, 6,607,081 or 6,607,124, the disclosures of each of which are incorporated herein by reference. The deposit accepting mechanism may be of the type that is shown in U.S. Pat. No. 6,554,185, the disclosure of which is incorporated herein by reference. In addition, the ATM may include a control system for controlling the transaction function devices that are operated in the machine. The ATM may also communicate with other computers so as to enable the carrying out of transactions. This may be done, for example, in the manner shown in U.S. Pat. No. 6,598,023, the disclosure of which is also incorporated herein by reference. Of course these devices and systems are exemplary, and in other embodiments other approaches may be used.

Figure 5:
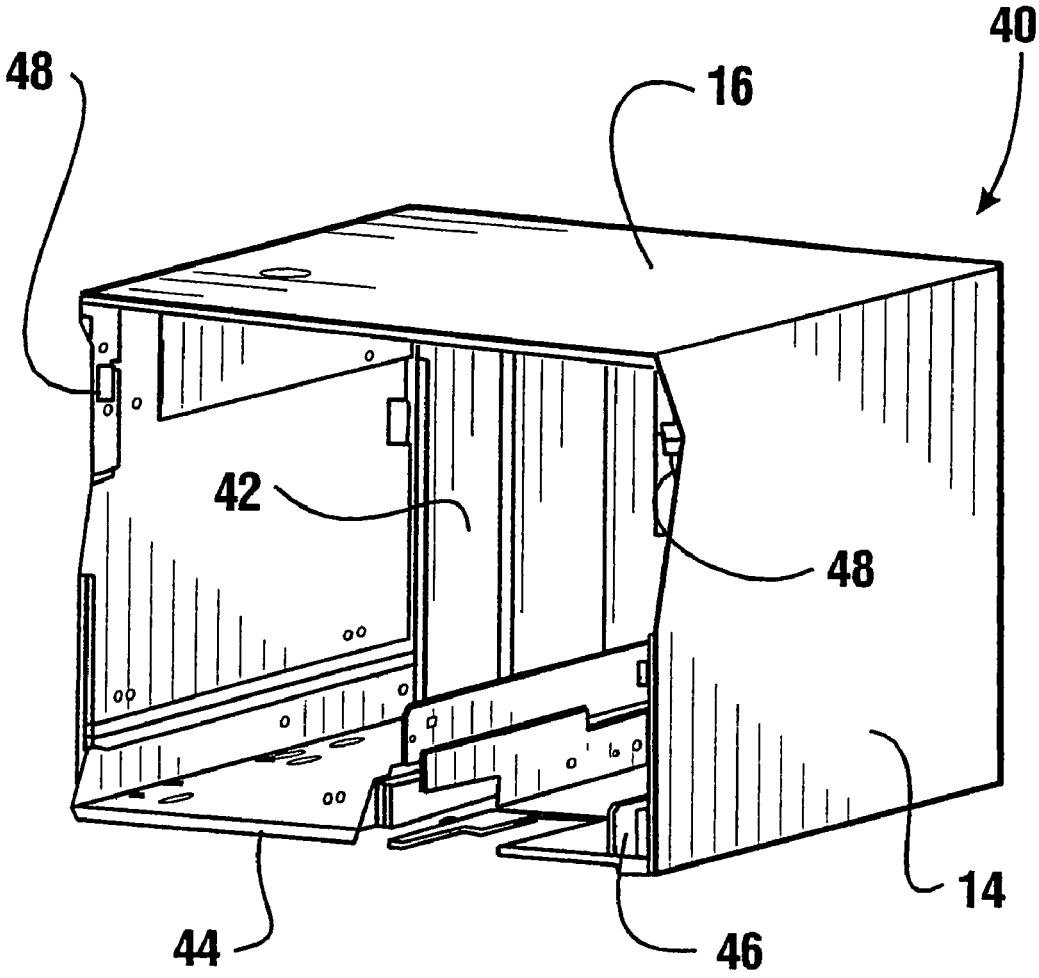
FIG. 5 is an isometric view of the enclosure for the automated teller machine.

As shown in FIG. 5, the upper portion of enclosure 12 is a top assembly 40 which is installed on the lower portion 36. Top portion 40 includes the upper sections of side walls 14 and top wall 16. Assembly 40 further includes a central dividing wall 42 and a bottom wall 44 which is supported on the lower portion 36.

Dividing wall 42 divides the interior of assembly 40 generally into equal width sides. Mounted on at least one side of assembly 40, and preferably on each side is a rollout tray 46 which is suitable for holding components of the automated teller machine which require periodic servicing. As later explained, depending on the type of automated teller machine the trays extend either through the front opening or the back opening of the machine.

Figure 4:
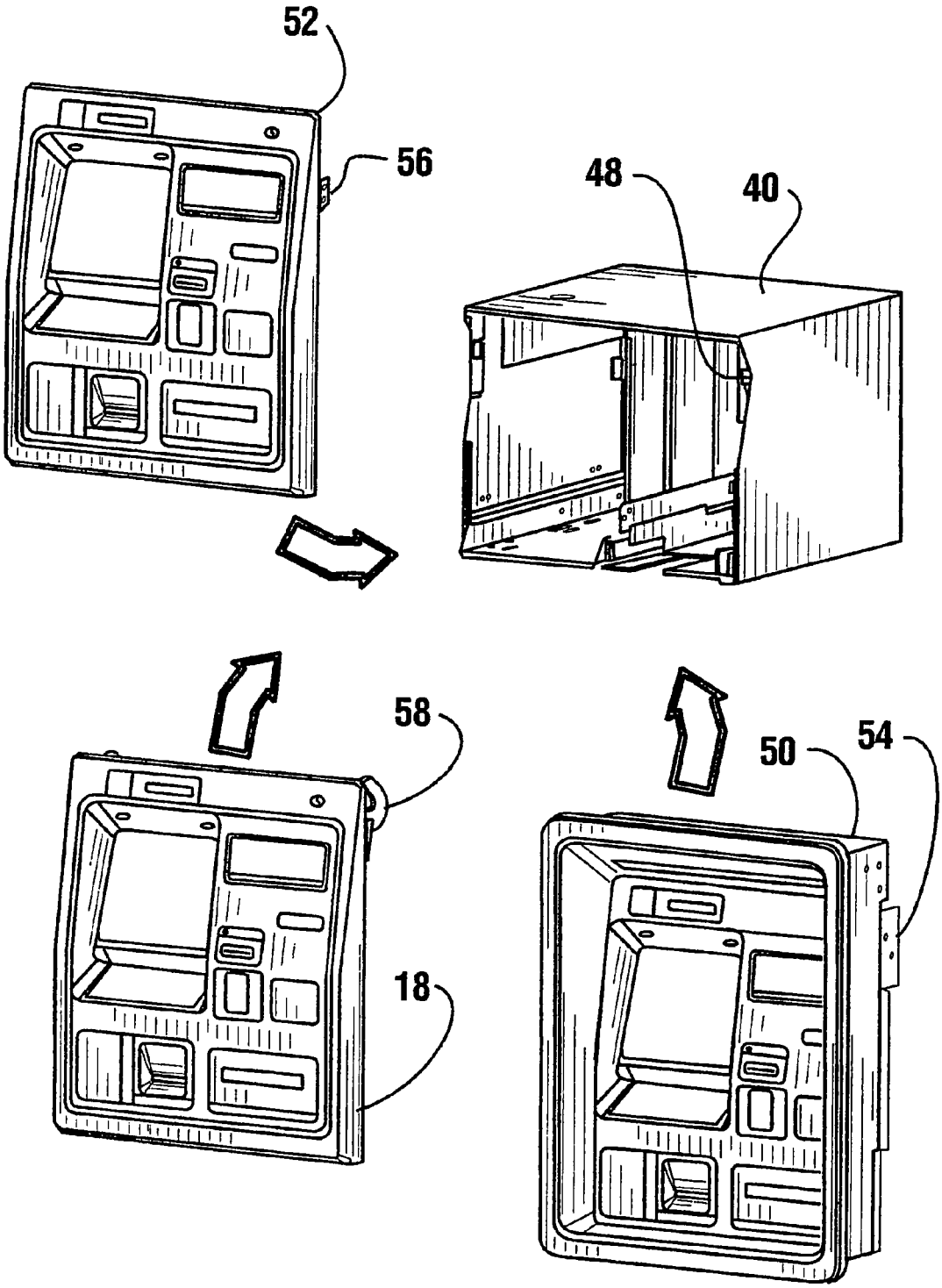
FIG. 4 is an isometric view of an exemplary universal enclosure for an automated teller machine and the alternative types of fascias that may be installed thereon.

Top assembly 40 further includes a pair of mounting areas 48 which extend on each of the side walls 14. As shown in FIG. 4, top assembly 40 is suitable for having mounted thereon fascia 18, which is a fascia for a front load lobby type ATM assembly or, alternatively, a rear load through-the-wall assembly fascia 50 or, alternatively, a rear load lobby fascia 52. As shown in FIG. 4, the rear load through-the-wall fascia 50 and the rear load lobby fascia 52 include mounting brackets 54 and 56, respectively. Mounting brackets 54 and 56 include holes therethrough that are aligned with mounting holes in the mounting areas 48 of assembly 40. Conventional fasteners are installed to permanently affix either fascia 50 or fascia 52 to the mounting areas. These fasteners are installed from the inside of assembly 40 to avoid ready removal of these fascias. When fascia 50 or fascia 52 is installed on top assembly 40, the front opening of the assembly is generally permanently closed, and in such ATMs the back opening is provided with a access door for servicing.

Figure 2:
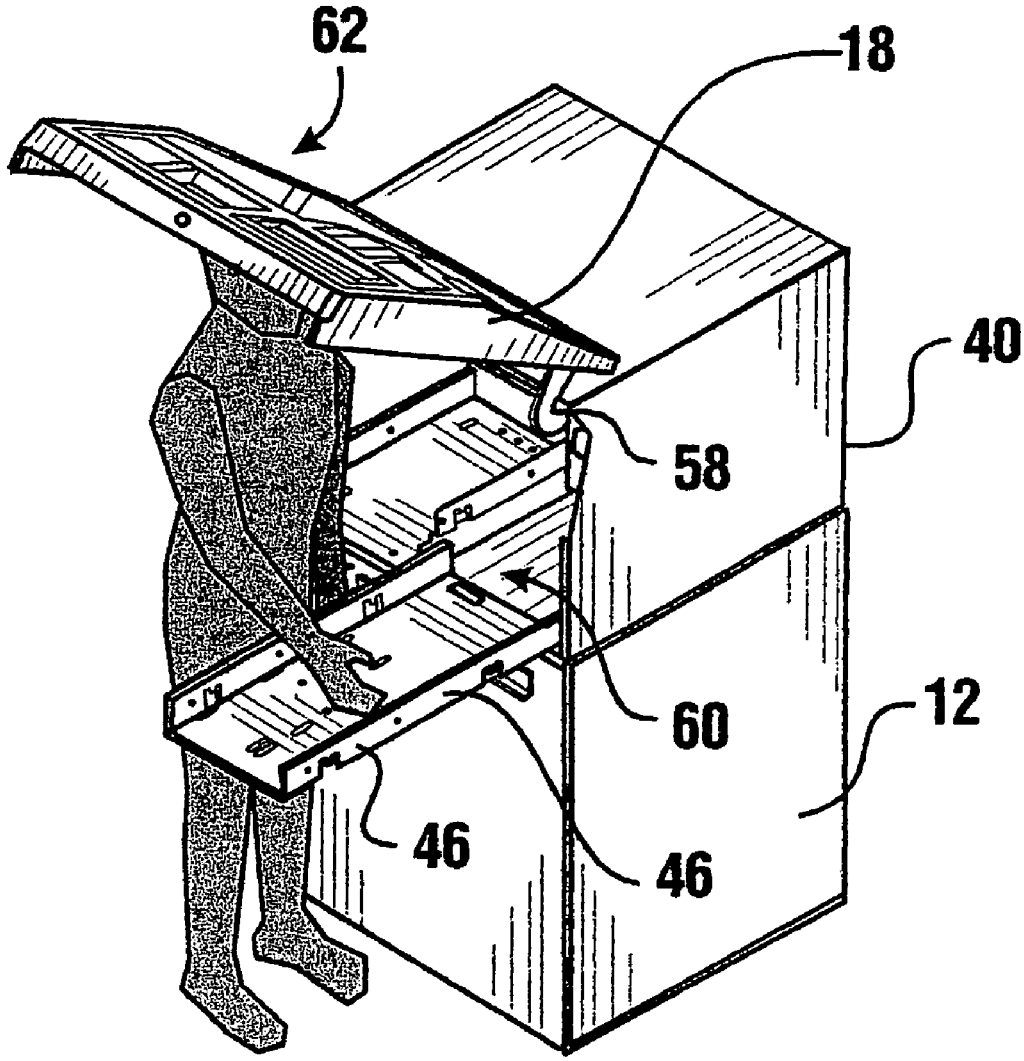
FIG. 2 is an isometric view of the automated teller machine shown in FIG. 1 with a service technician shown in position for working on the components thereof.
Figure 3:
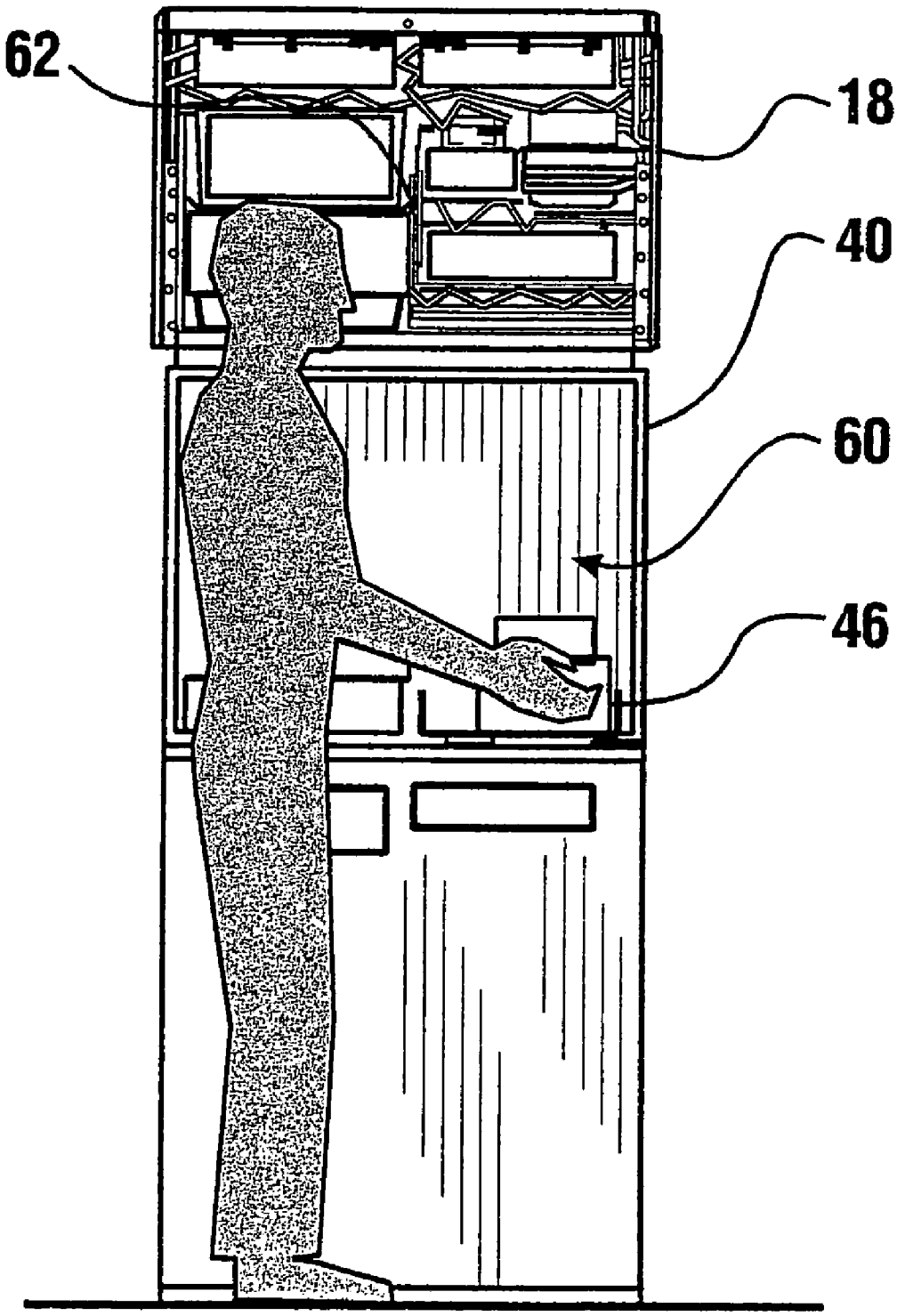
FIG. 3 is a front plan view of the automated teller machine and technician shown in FIG. 2.

Fascia 18, on the other hand, includes a pair of lifting arms 58 which are pivotally mounted on pins in the mounting areas 48. As a result, fascia 18 is enabled to be moved upwardly as shown in FIGS. 2 and 3. In an exemplary embodiment using front load fascia 18, the rear opening of assembly 40 is permanently closed by a closure panel (not separately shown) that is attached thereto. The closure panel is preferably held by fasteners and brackets that extend in the interior of the assembly to minimize the risk of unauthorized persons gaining access thereto.

As shown in FIGS. 2 and 3, the ATM enclosure 12 with the front load fascia panel 18 thereon is enabled to be accessed through a front opening 60 in top assembly 40. Fascia 18 may be lifted for servicing of the ATM and held by gas springs 61 (see FIG. 10) in the upright position. This enables ready servicing of the machine by a technician as demonstrated in FIGS. 2 and 3.

The trays 46 are mounted in the assembly 40 in drawer-like fashion such that the trays and the electronic components located thereon may be moved forward through the front opening 60. The technician is enabled to stand to the side of the extended tray 46 to service the components located thereon. Further, the screen opening 62 which provides visual access to the screen 22 in the down position of the fascia 18 provides an opening through which a technician may extend his head during servicing of the components that are located on extended tray 46.

When the technician has completed servicing the equipment on tray 46, they may return the tray and components into the interior of assembly 40. Thereafter the technician may step to the opposite side of the machine in front of the tray that has been returned and work on components on the opposite side of the assembly and/or pull out components located on a similar tray therein. The trays include a latching mechanism (not shown) to hold them in position when retracted into assembly 40.

A technician servicing the machine shown in FIGS. 1 through 3 need never leave the area directly in front of the machine and under the raised fascia 18. The "footprint" for servicing of the machine is much smaller than it would be if the machine were constructed with a full width tray and the technician had to stand further ahead of the tray when it was extended. The exemplary ATM can be installed in tighter spaces than would otherwise be possible. Of course, when the technician has completed servicing the machine, the fascia 18 may be pivoted downward to again cover the front opening to the enclosure in locked position using an appropriate locking mechanism.

Figure 20:
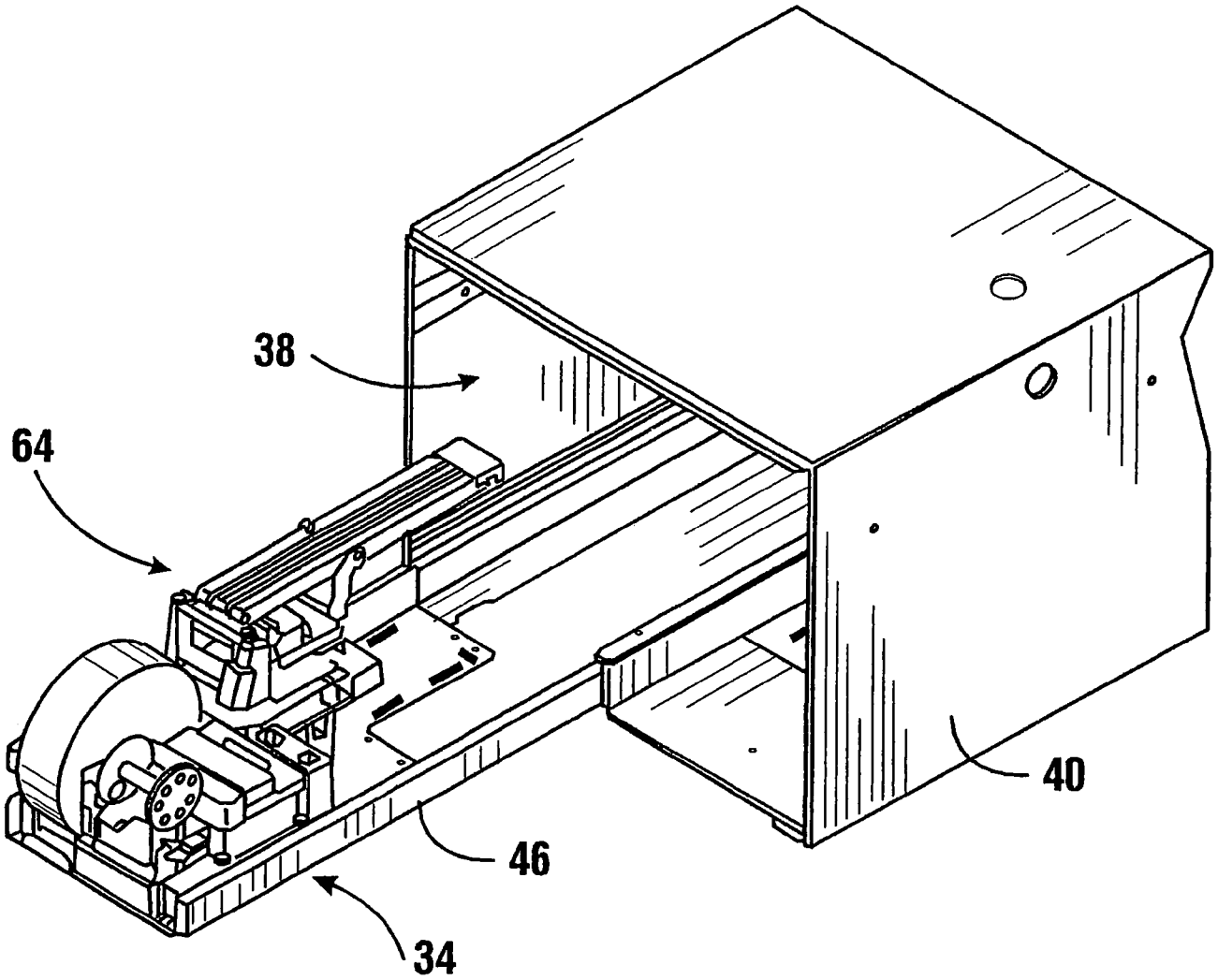
FIG. 20 is a rear isometric view of the receipt printer and delivery mechanism shown in a position extended from the enclosure of the machine for servicing.

In cases where the fascias 50 or 52 are permanently installed at the front of assembly 40 so as to close the front opening, the rollout trays 46 are installed in the top assembly 40 to be movable out the back opening 38 as shown in FIG. 20. For ATMs of this type, the back opening 38 is provided with a swing open door (not shown) which can be locked in closed position by a suitable locking mechanism. For these configurations the technician is enabled to stand behind the machine on one side and extend the tray 46 on the opposite side to service the components thereon. Thereafter, the technician may reverse sides and work on the components on a tray or otherwise positioned in the opposed side of the enclosure. The technician is enabled to service the components of the machine without having to work behind the trays. As a result, the rear of the machine may be installed in closer proximity to a wall which saves space.

Figure 7:
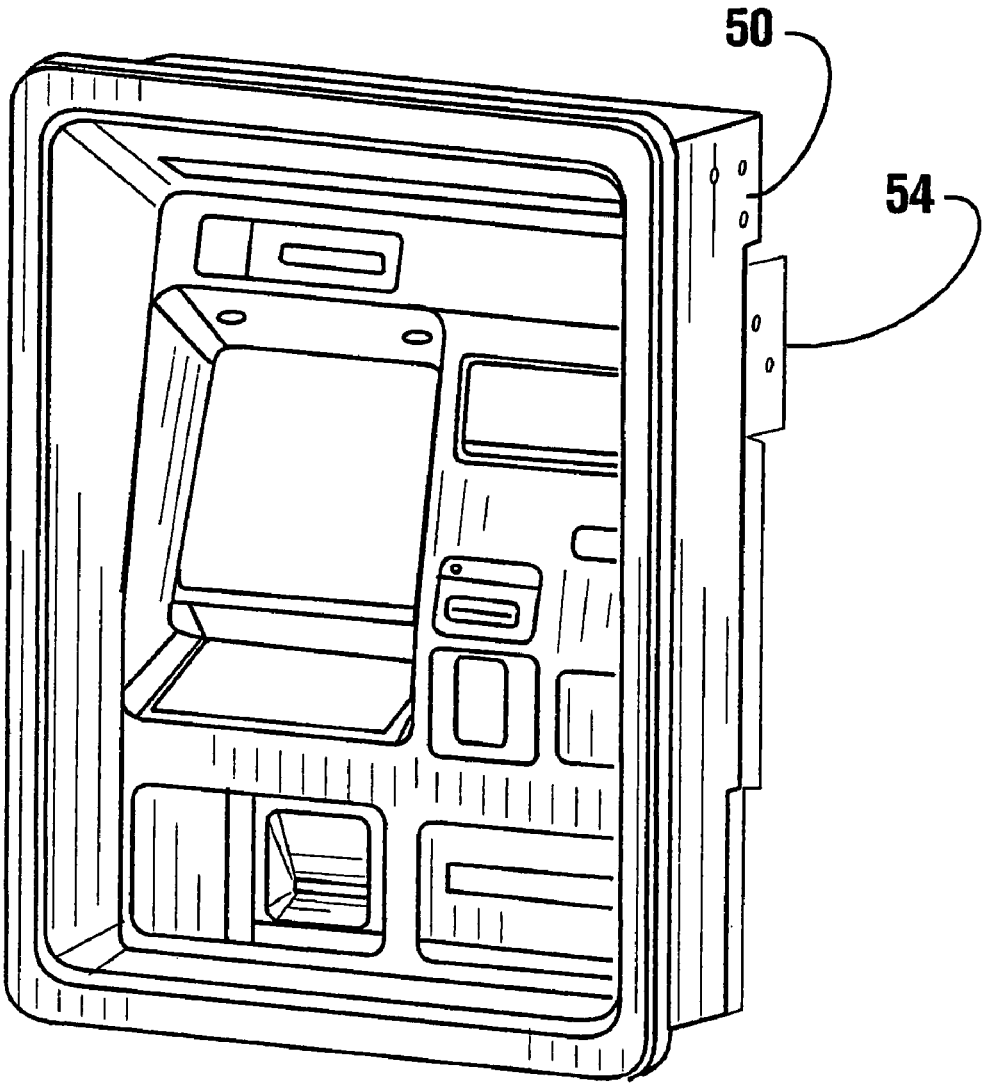
FIG. 7 is a front isometric view of a fascia panel for a through-the-wall mounted automated teller machine.
Figure 8:
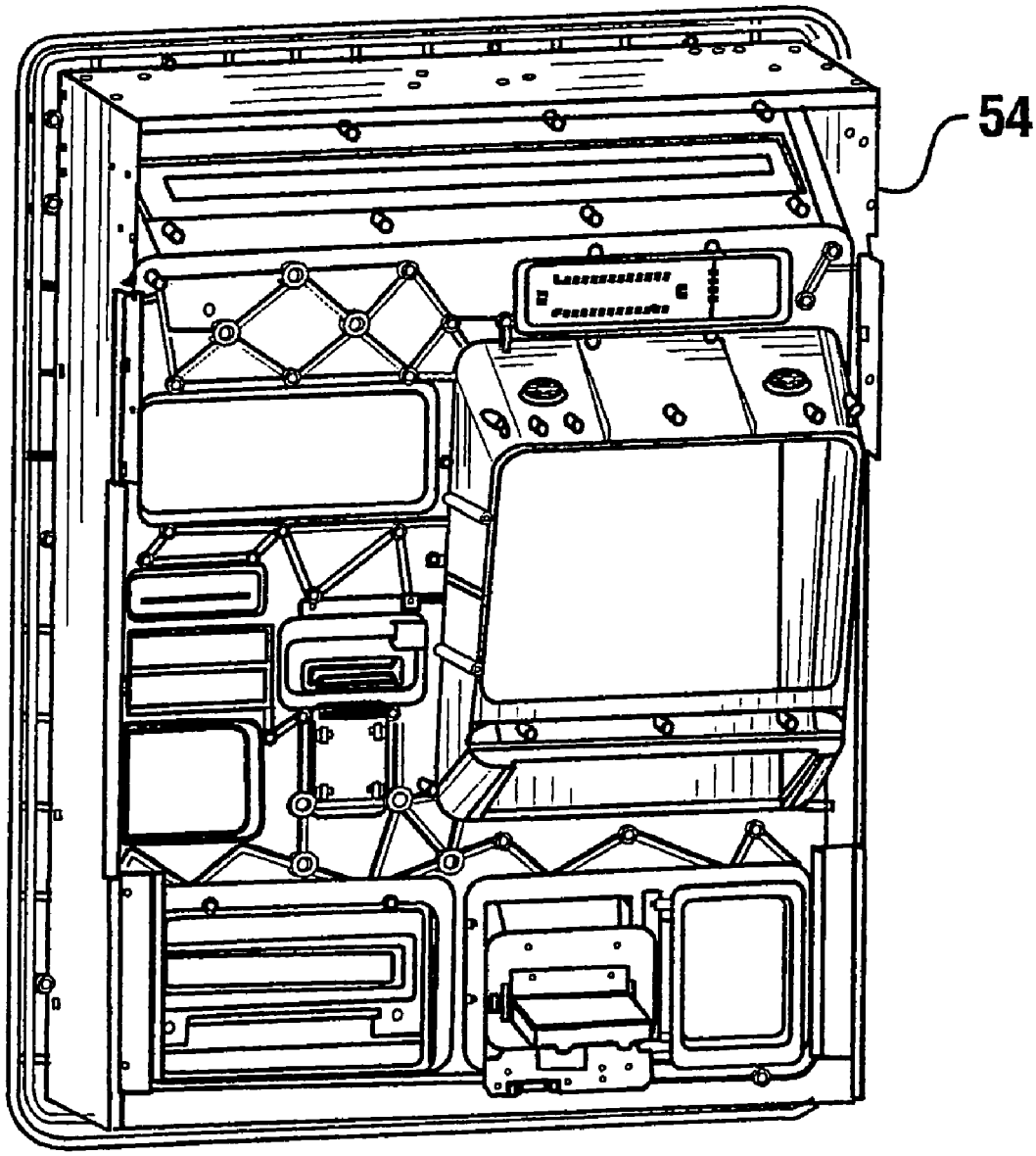
FIG. 8 is a back isometric view of the fascia panel shown in FIG. 7.
Figure 9:
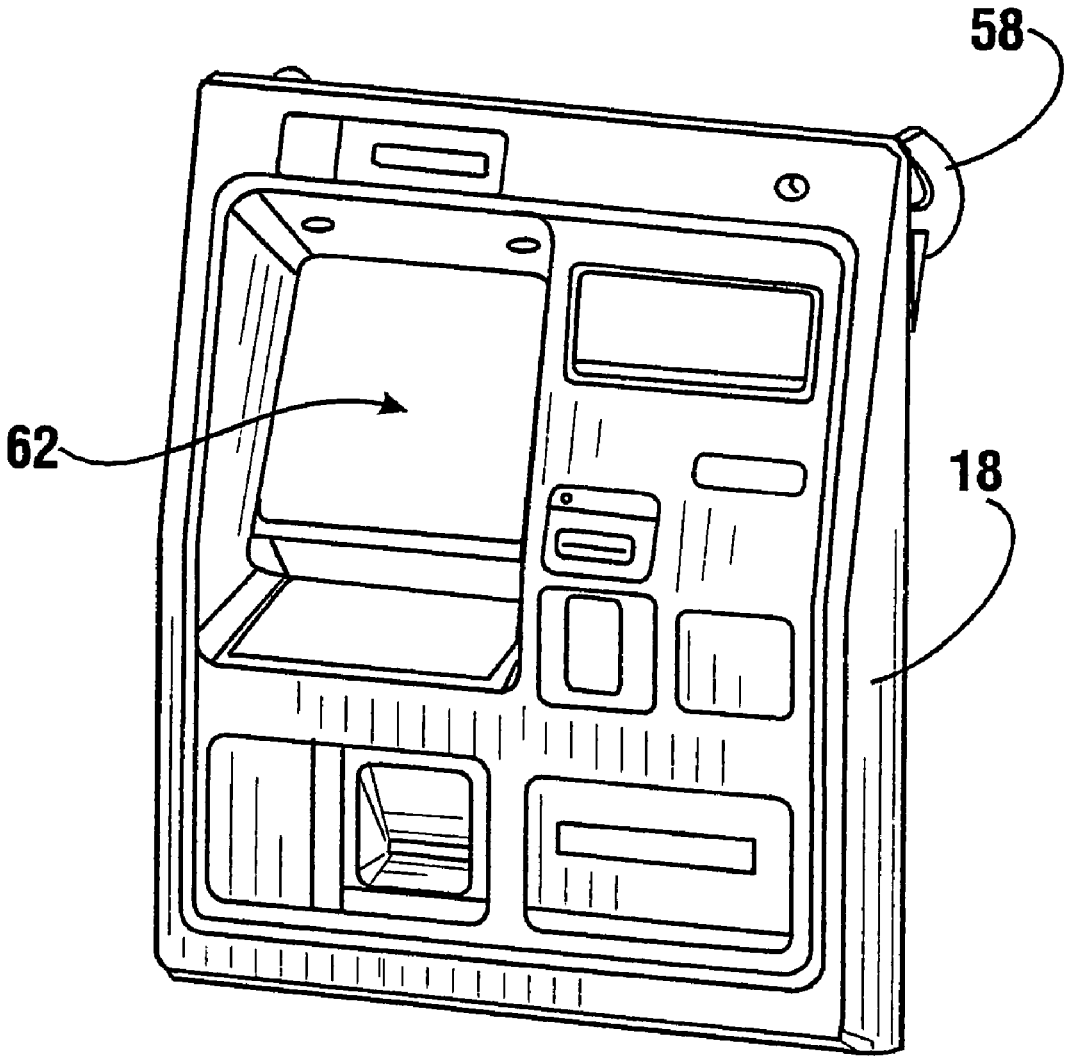
FIG. 9 is a front isometric view of a fascia panel for a lobby installed automated teller machine.
Figure 10:
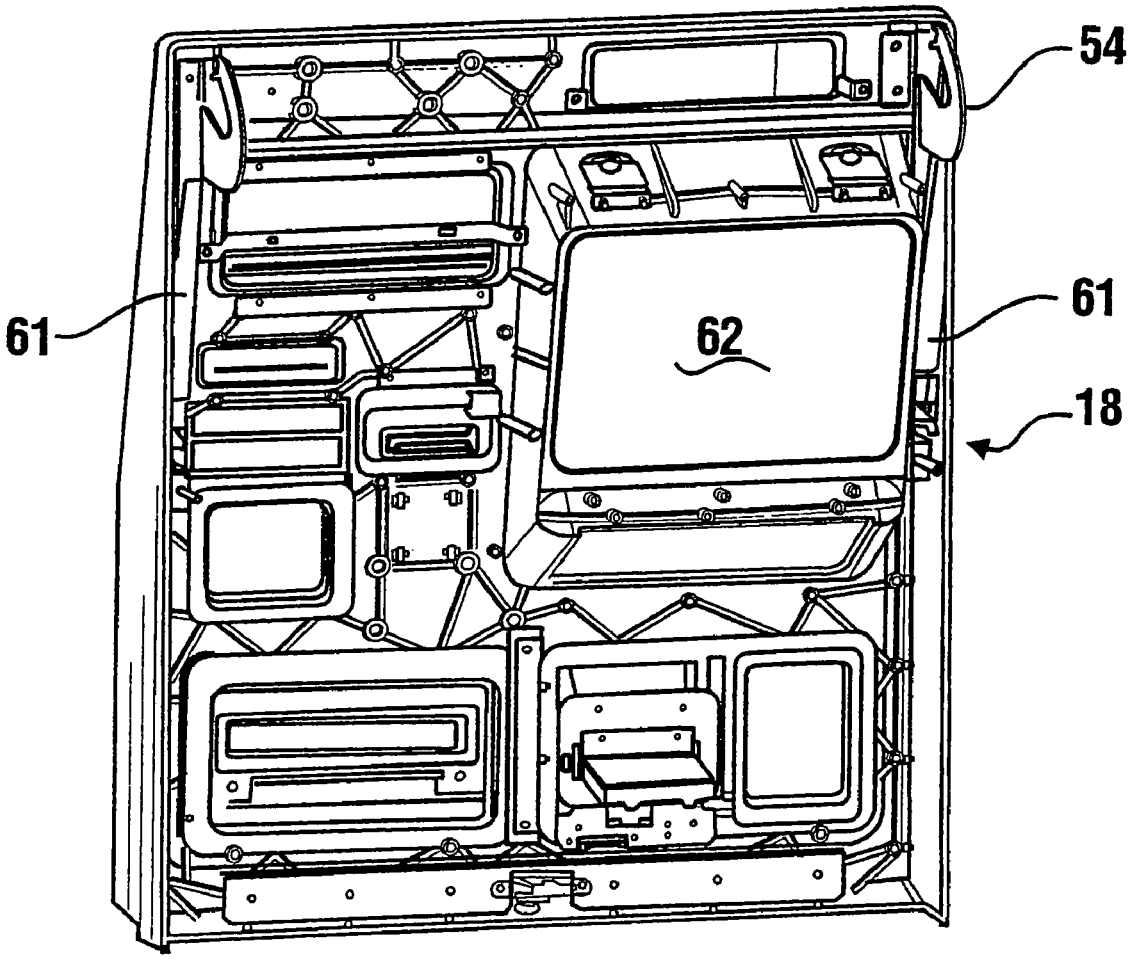
FIG. 10 is a rear isometric view of the fascia panel shown in FIG. 9.

FIG. 7 is a front isometric view of a fascia panel for a through-the-wall mounted automated teller machine. FIG. 8 is a back isometric view of the fascia panel shown in FIG. 7. FIG. 9 is a front isometric view of a fascia panel for a lobby installed automated teller machine. FIG. 10 is a rear isometric view of the fascia panel shown in FIG. 9.

Figure 11:
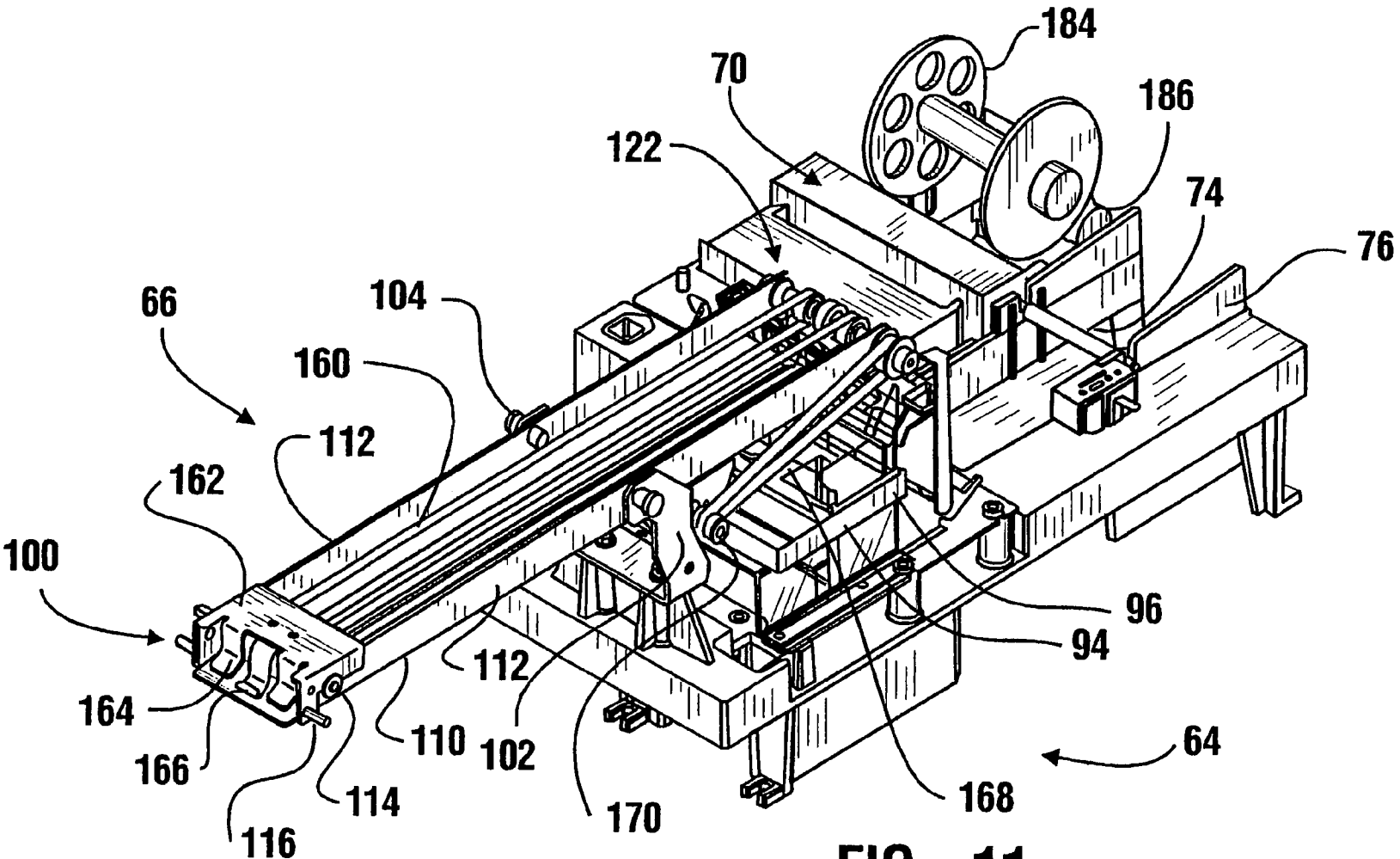
FIG. 11 is a side isometric view of an exemplary receipt printer assembly and receipt delivery mechanism.

In an exemplary embodiment, a component that is mounted on rollout tray 46, regardless of the type of fascia used, is a receipt and journal printer and receipt delivery assembly 34 as shown in FIG. 11. Assembly 34 includes a receipt transport generally indicated 66. Assembly 34 further includes a receipt printer mechanism generally indicated 68 (see FIGS. 12 and 13) and a journal printer mechanism generally indicated 70.

Figure 13:
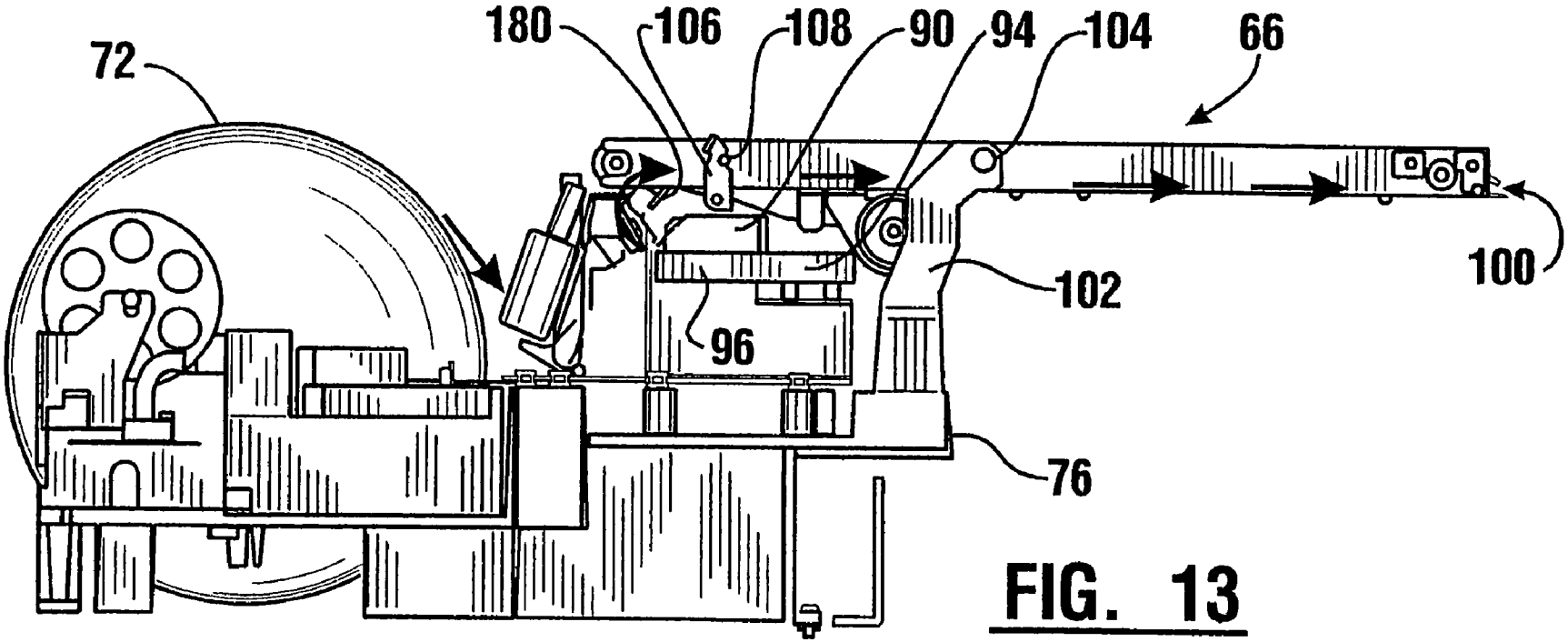
FIG. 13 is a right side view of the receipt printer and delivery mechanism shown in FIG. 11.
Figure 17:
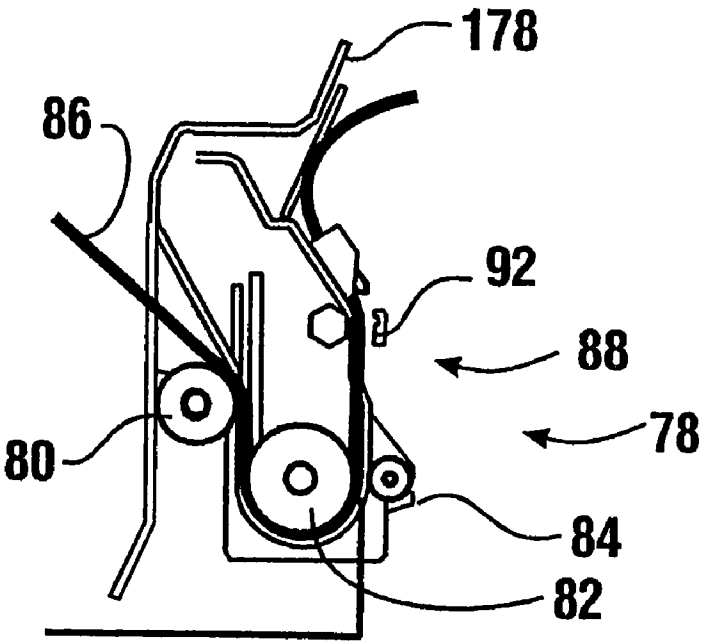
FIG. 17 is a cross sectional view showing the paper path through the receipt printing mechanism.

The function of the receipt printer mechanism 68 is to print customer receipts on paper that is drawn from a roll 72. Roll 72 is journaled on a shaft 74 supported on a base 76 of the receipt printer. As shown in FIGS. 13 and 17, paper from the roll 72 is drawn through a printer feed and cutter housing 78 wherein guiding and driving rolls 80, 82 and 84 pull the paper 86 therethrough. The paper is guided to a printing position, generally indicated 88 in the printer housing. In the printing position, the pins of an impact print head 90 strike the paper 86 through a ribbon 92 to enable printing of characters on the paper.

The ribbon extends from the side of a ribbon cartridge 94 which has ribbon guide arms 96 which straddle the print head (see FIG. 11).

Printer housing 78 includes a knife (not separately shown) which is actuated by a solenoid 98 which cuts off the paper 86 after the receipt has been printed. Thereafter the receipt is delivered by the transport 66 in a manner later explained to an opening 100 at the end of the transport where it may be taken by a customer through receipt opening 26 of the fascia.

Figure 18:
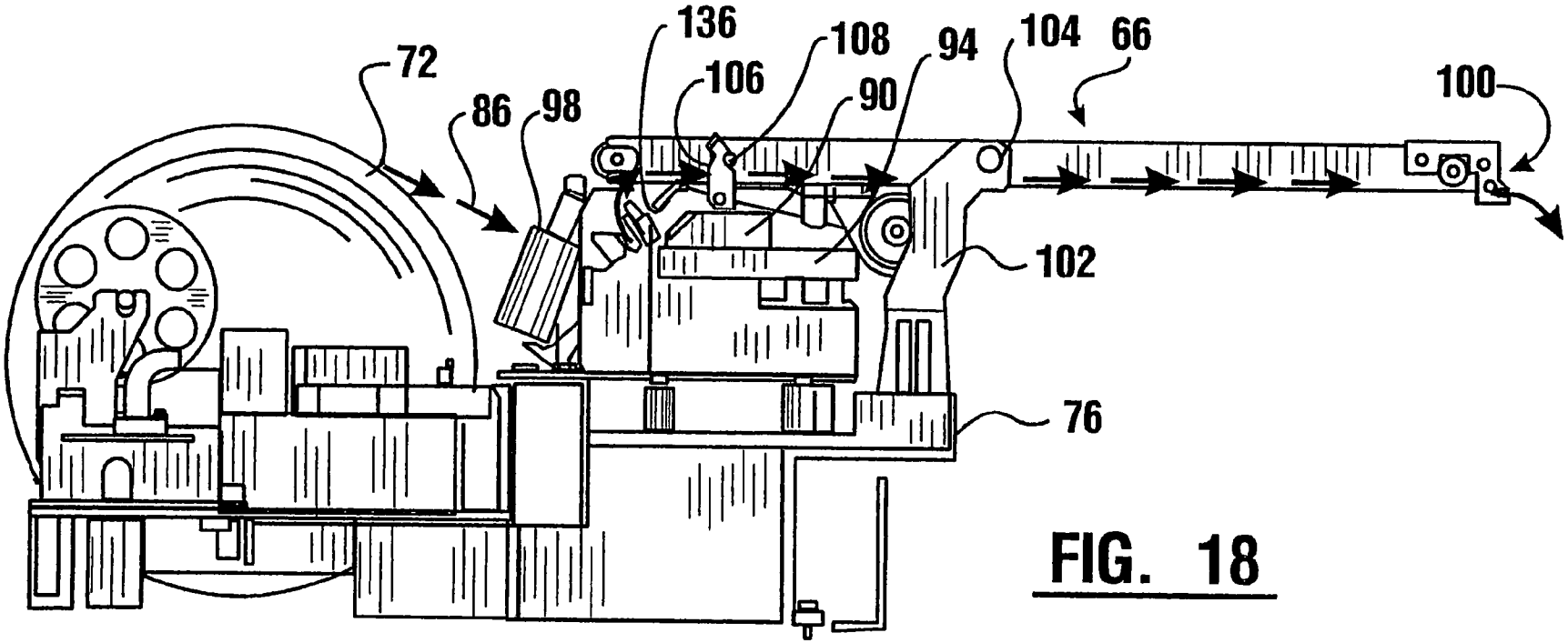
FIG. 18 is a right side view showing the paper path through the receipt printer and delivery transport mechanism in the receipt delivering position.

As best shown in FIGS. 13 and 18, in the operable position of the receipt transport 66, the transport extends over the print head 90 as well as the cartridge 94. Because the cartridge 94 requires periodic replacement, the transport 66 is mounted to pivot on a pair of arms 102 which extend upward from a U-shaped bracket mounted on the base 76. The arms each have a pin 104 which is engaged to the transport. As later explained, each pin extends through a slightly slotted opening in the side walls of the transport frame which enables the transport to have a slightly floating mounting.

Figure 19:
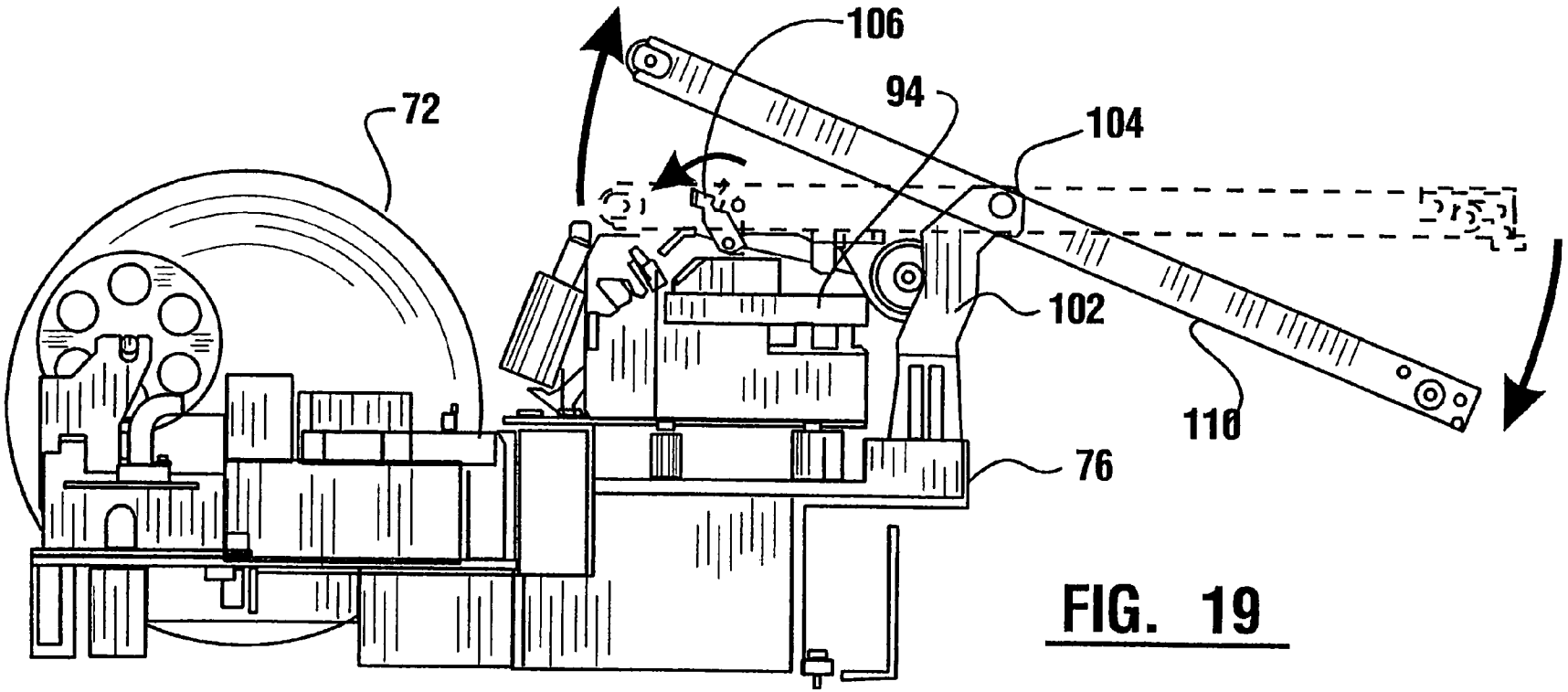
FIG. 19 is a right side view of the receipt printing mechanism and delivery transport shown in the position for servicing of the printer and ribbon.

As shown in FIGS. 18 and 13, a lever 106 is pivotally mounted to a fixed member that extends above the print head. Lever 106 is spring loaded and includes a notch that is engageable with a pin 108 that is located on the receipt transport 66. When it is desired to change the cartridge 94, or service the print head, receipt transport 66 may be pivoted forward by disengaging lever 106 from pin 108. This enables the front of the transport mechanism to be moved downward as shown in FIG. 19 to provide access to those components. After the servicing is completed, the transport is rotated back to the position shown in FIGS. 13 and 18 wherein it is automatically latched into position by a spring loaded lever 106.

As previously discussed, transport 66 includes a U-shaped frame 110 which includes a pair of spaced upward extending side walls 112 and a traversely extending bottom wall 114. The openings in side walls 112 which accept pins 104 are slightly vertically elongated. This enables the opening 100 at the outer end of the receipt transport 66 to float slightly up and down.

Figure 15:
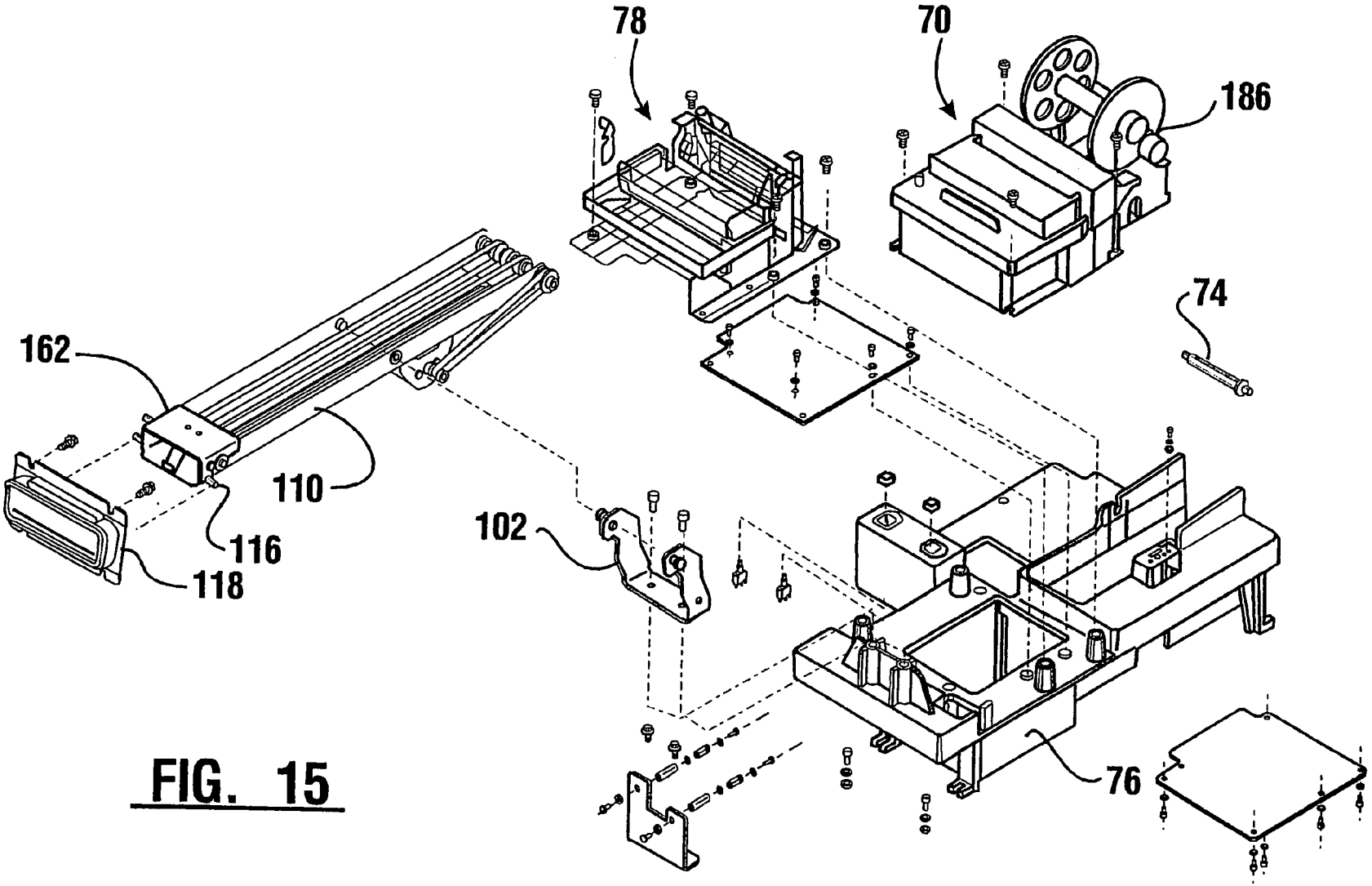
FIG. 15 is an exploded view of the components of the receipt printer and delivery mechanism.

A pair of pins 116 extend on opposed sides of opening 100. Pins 116 are sized for acceptance in V-shaped slots that extend inwardly from the backs of the fascias 18, 50 and 52. As a result, when the fascia is moved adjacent to opening 100 or, alternatively the transport is moved into proximity with a fixed fascia, the opening 100 is aligned with the appropriate opening in the fascia to deliver the receipts therethrough. The floating character of the transport 66 enables the transport to accommodate slight misalignments with the fascia while still delivering the receipts properly therethrough. As shown in FIG. 15, the fascia includes an insert 118 which includes the rearward extending slots which align the opening 100 at the end of the receipt transport 66.

Figure 14:
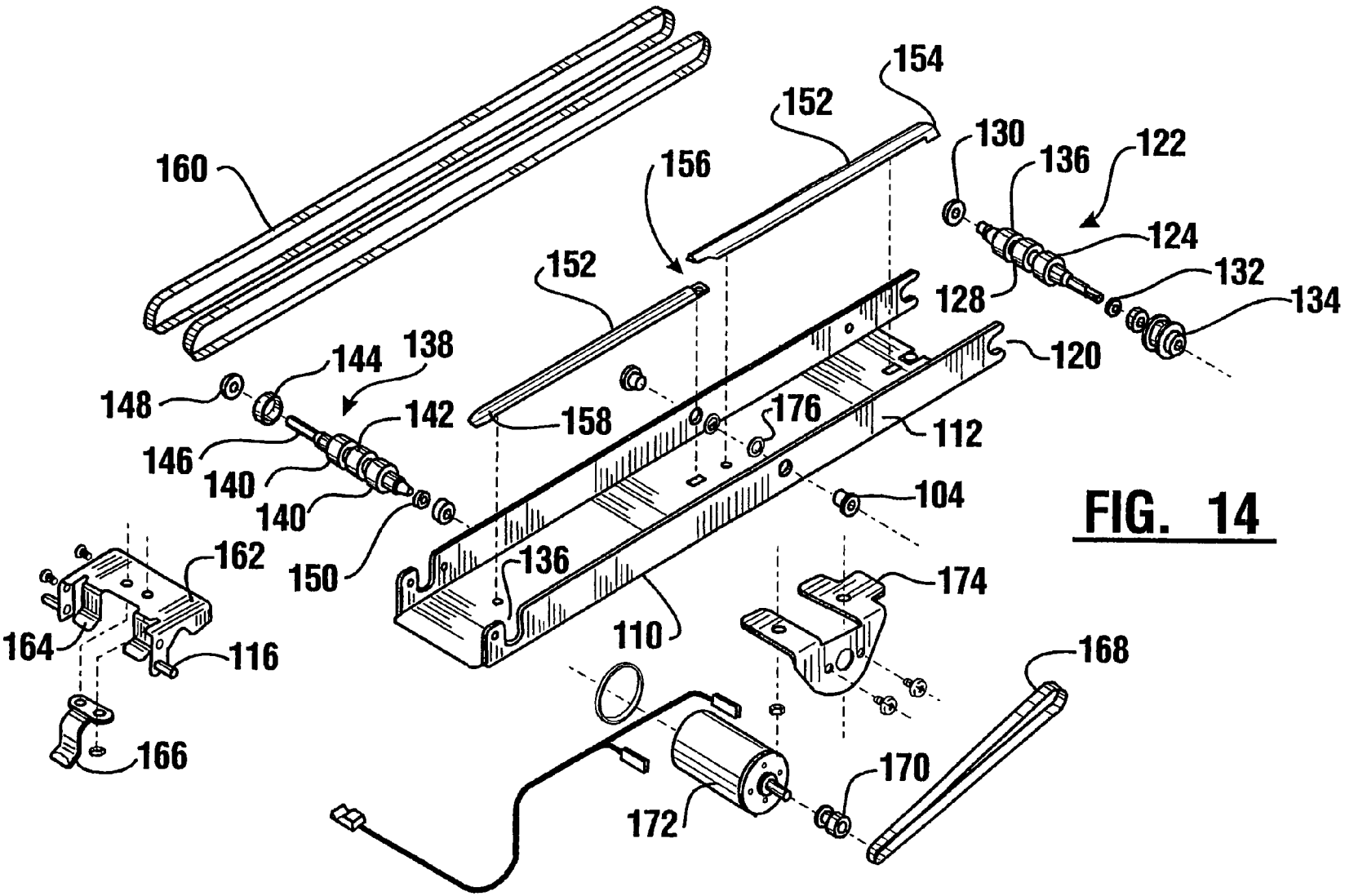
FIG. 14 is an exploded view of the receipt delivery transport mechanism.

The frame member 110 has longitudinally extending notches 120 in the side walls 112 thereof. As best shown in FIG. 14, notches 120 accept a back axle assembly 122 therein. The back axle assembly includes an axle shaft 124 which has a pair of belt driving rolls 126 and a center guide roll 128 thereon. Axle shaft 124 is stepped to axially position flanged bushings 130 which nest in notches 120. A wave spring 132 is mounted on the shaft between a step and a bushing to take up any end play. A drive pulley 134 is mounted on shaft 124.

Frame 110 further includes vertically extending notches 136 in the side walls 112. Notches 136 accept a front axle assembly 138. Front axle assembly 138 includes a pair of belt driving rolls 140 and a guide roll 142 thereon. Guide roll 142 further includes a resilient overlying feed roll cover 144 thereon.

Rolls 140 and 142 are mounted on an axle shaft 146 which is a stepped shaft similar to shaft 124. A pair of bushings 148 enable shaft 146 to nest in notches 136. A wave spring 150 mounted on shaft 146 between a bushing and a step on the shaft takes up of any play therein.

Figure 16:
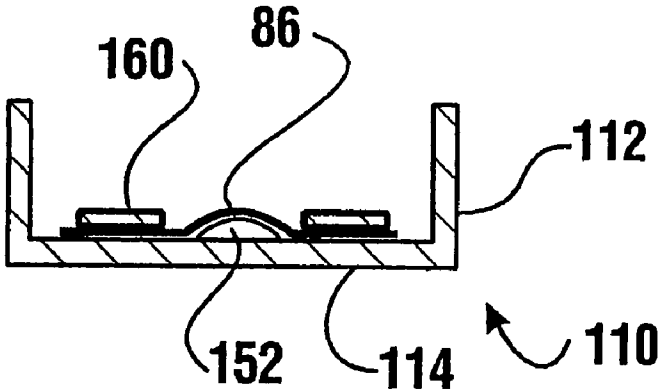
FIG. 16 is a cross sectional view of the receipt delivery transport.

A two piece centrally extending rib 152 extends upward from the bottom wall 114 of frame 110 (see FIG. 16). Rib 152 has a tapered lead-in section 154 which extends through a notch in the bottom wall 114 to facilitate engagement of paper onto the rib as later explained. The rib further includes a tongue-and-groove connection 156 where the rib sections are joined to enable the rib 152 to have a substantially smooth and continuous upper surface. The rib further includes an outlet section 158 that is tapered to provide a smooth area for disengagement of the paper and the rib. The rib is fastened to the bottom wall 114 through projections which extend through alignment slots and fasteners.

A pair of resilient belts 160 extend between the belt driving rolls 126 and 140 in the front and back axle assemblies. As shown in FIG. 16, the lower belt flights are positioned on opposed sides of rib 152. The lower belt flights are supported on the lower wall 114 and are movable to accept paper moving thereinbetween.

FIG. 14 also shows a bracket 162 that is mounted on frame 110 at opening 100 of the transport. Bracket 162 includes the alignment pins 116. Bracket 162 includes a pair of downward extending finger projections 164 which direct paper downward as it reaches the transport opening. A spring 166 extends downward from the center of bracket 162. Spring 166 is in contact with lower wall 114 of the transport frame and serves to hold receipt papers in position thereunder.

The drive pulley 134 on axle shaft 124 is driven by a belt 168. Belt 168 is driven by a pulley 170 that is mounted on the drive shaft of a motor 172. Motor 172 is mounted in a bracket 174 which extends from the underside of frame 110.

As shown in FIG. 14, the pins 104 which extend through the elongated holes in the side walls 112 of the transport frame 110 are held in position by locking rings 176.

As shown in FIG. 18, paper 86 is unrolled from roll 72 and travels along the path of the arrows as shown. The paper passes through the printer housing 78 where characters are printed by the print head through the ribbon 92. As the printing occurs, the rolls 82 and 84 guide and advance the paper.

As the paper rises up out of the print housing, it is urged to the forward position by a forward extending tab 178. The paper is further guided upward by a tab 180 which extends downward and angularly rearward from the bottom wall 114 of the transport frame 110. The paper upon reaching the top of tab 180 is contacted by the lower flights of belt 160 and the lead-in section of rib 152. As soon as motor 172 is started, the paper is pulled between the belts 160 and the rib 152 as shown in FIG. 16.

In operation, the receipt is printed in housing 78 and cut off by the knife assembly therein. Immediately thereafter motor 172 is started which causes the receipt to be engaged between rib 152 and the drive belts 160 as shown in FIG. 16, in which position it is rapidly pulled forward in the transport and under the guide roll 142 of axle shaft 146. The receipt is urged downwardly by the fingers 164 and bracket 162 and is held in place extended through the opening 26 in the fascia by spring 166. The customer then takes the receipt and the transport is ready to deliver additional receipts. If the customer does not take their receipt, additional receipts will push the existing receipt out of the opening and the new receipt held in position extending out of the opening in the ATM.

The exemplary receipt transport provides for generally rapid and jam-free delivery of receipts to a customer. It also achieves a reduction in space by allowing the print head 90 and print ribbon cartridge 94 to be installed under the transport while still enabling access thereto for servicing and changing the print ribbon.

Figure 12:
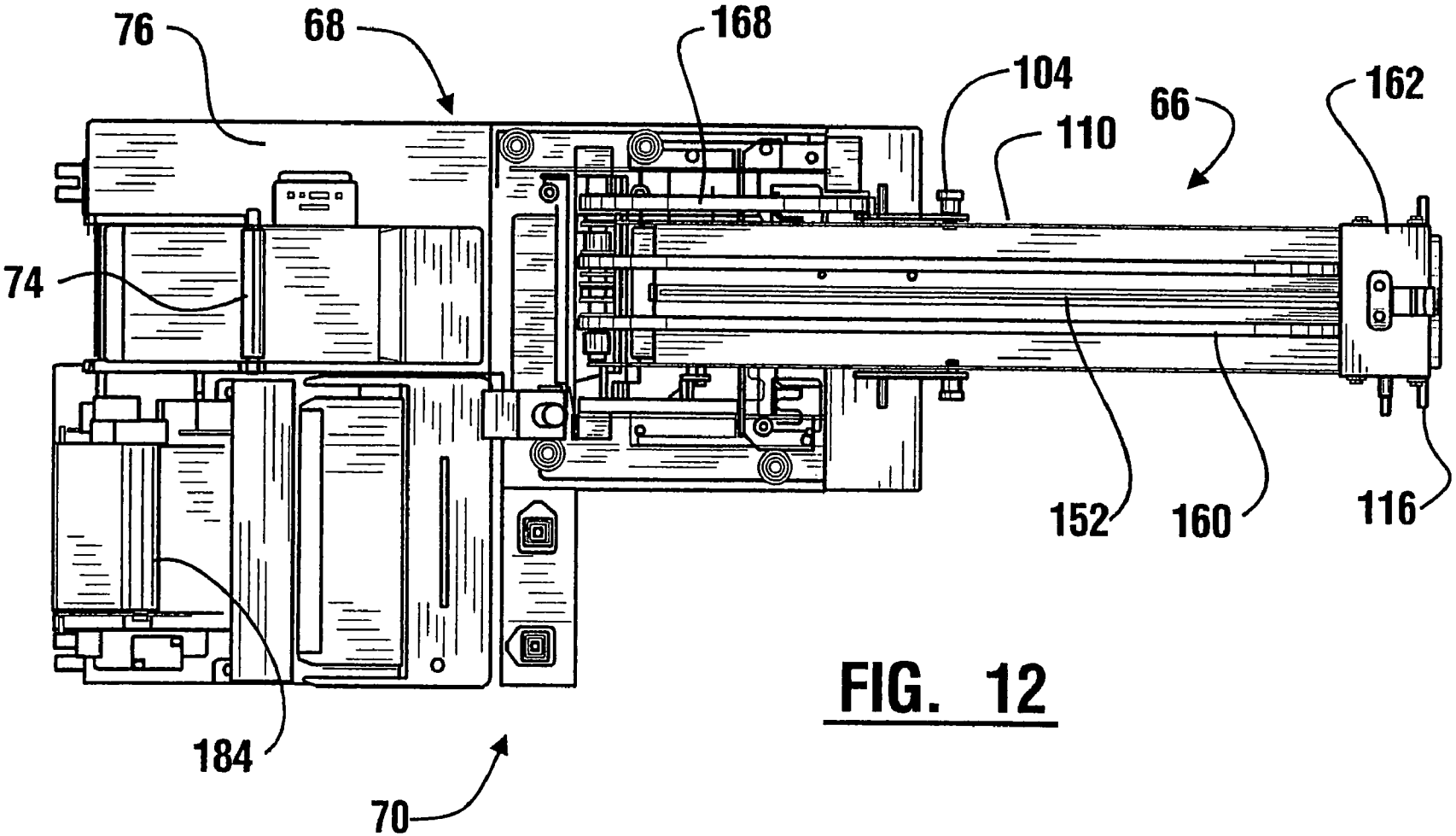
FIG. 12 is a top view of the mechanism shown in FIG. 11.

As shown in FIGS. 12 and 11, base 76 also has mounted thereon the journal printer generally indicated 70. The journal printer serves to record on a continuous tape the information that was provided to customers on customer receipts. It allows the institution operating the ATM to maintain a hard copy record of all the transaction information. The journal printer 182 operates to unroll paper mounted on a spool 184, to pass the paper through a printer mechanism and then rewind the paper onto another spool 186.

The side-by-side installation of the journal printer 182 on a common base 76 with the customer receipt printer provides for a compact unit and efficient installation on a rollout tray of the ATM as shown in FIG. 20. This installation further facilitates servicing and changing of the paper rolls on both the customer receipt and journal printers.

Alternative embodiments may include other types of printing mechanisms. For example, automated banking machines may include printers of the type shown in U.S. Pat. No. 6,547,464, the disclosure of which is incorporated herein by reference. Further, alternative embodiments may include other types of printers such as statement printers, documents printers, money order printers, or specialized printers that print indicia such as bar codes, magnetic ink coding, or other types of indicia appropriate for the functions that the particular automated banking machine carries out.

The exemplary embodiment also includes a unique mounting mechanism for the monitor of the ATM. The exemplary ATM enclosure may be adapted to have various types of fascias. A mechanism is therefore provided for aligning the customer interface screen 22 with the screen opening 62 in the various fascias.

Figure 21:
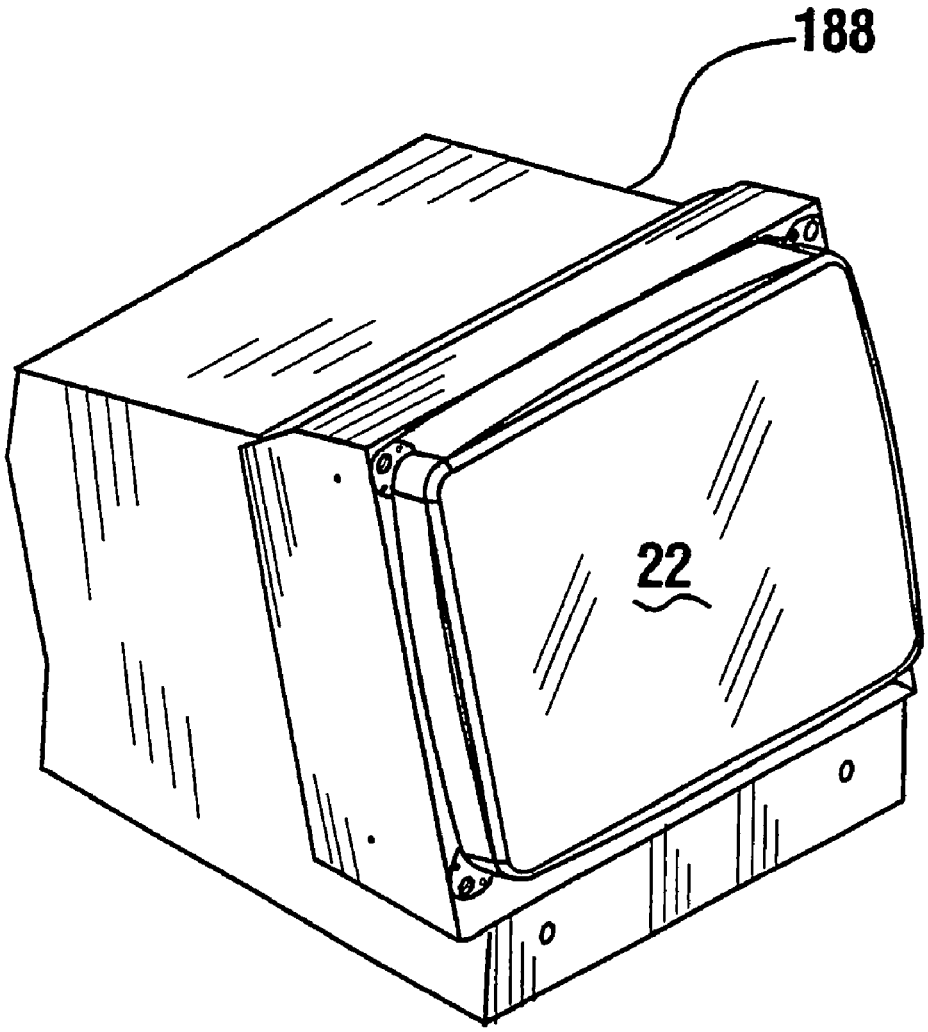
FIG. 21 is an isometric view of the monitor and screen of a customer interface of an automated teller machine.
Figure 22:
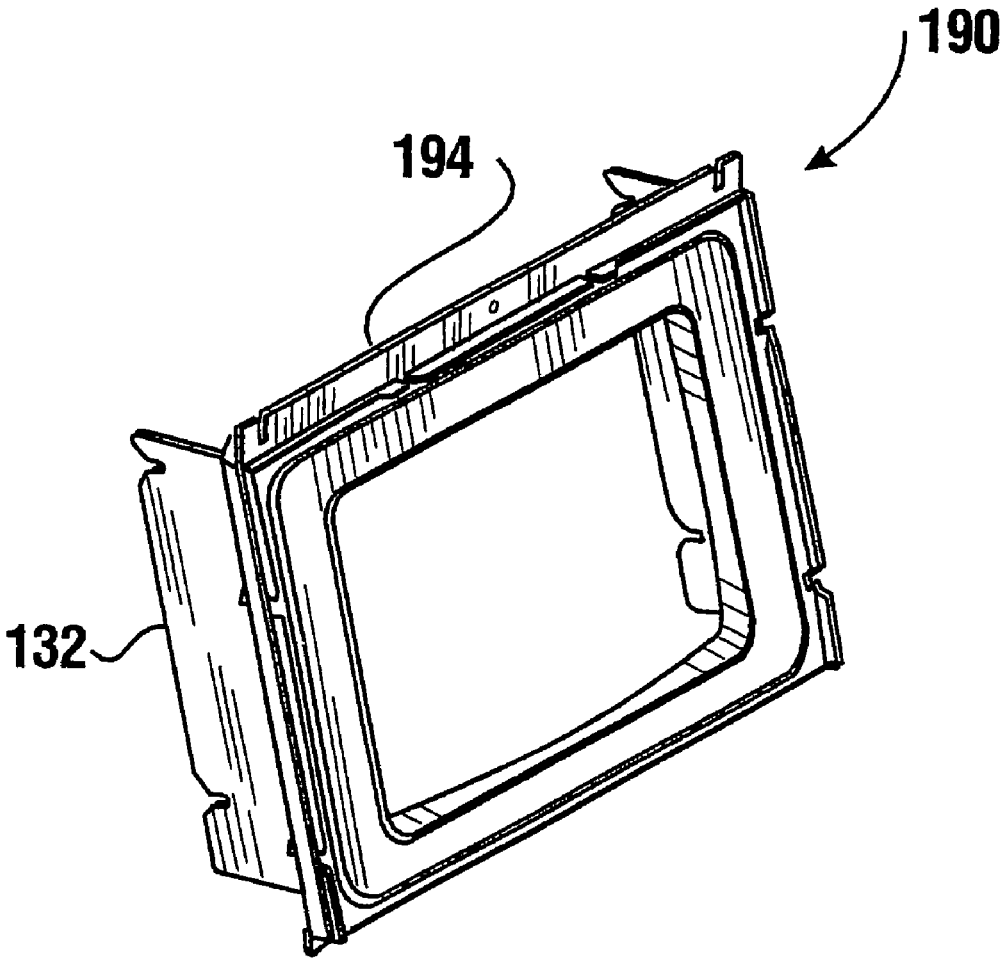
FIG. 22 is an isometric view of the screen surround assembly for the monitor shown in FIG. 21.
Figure 23:
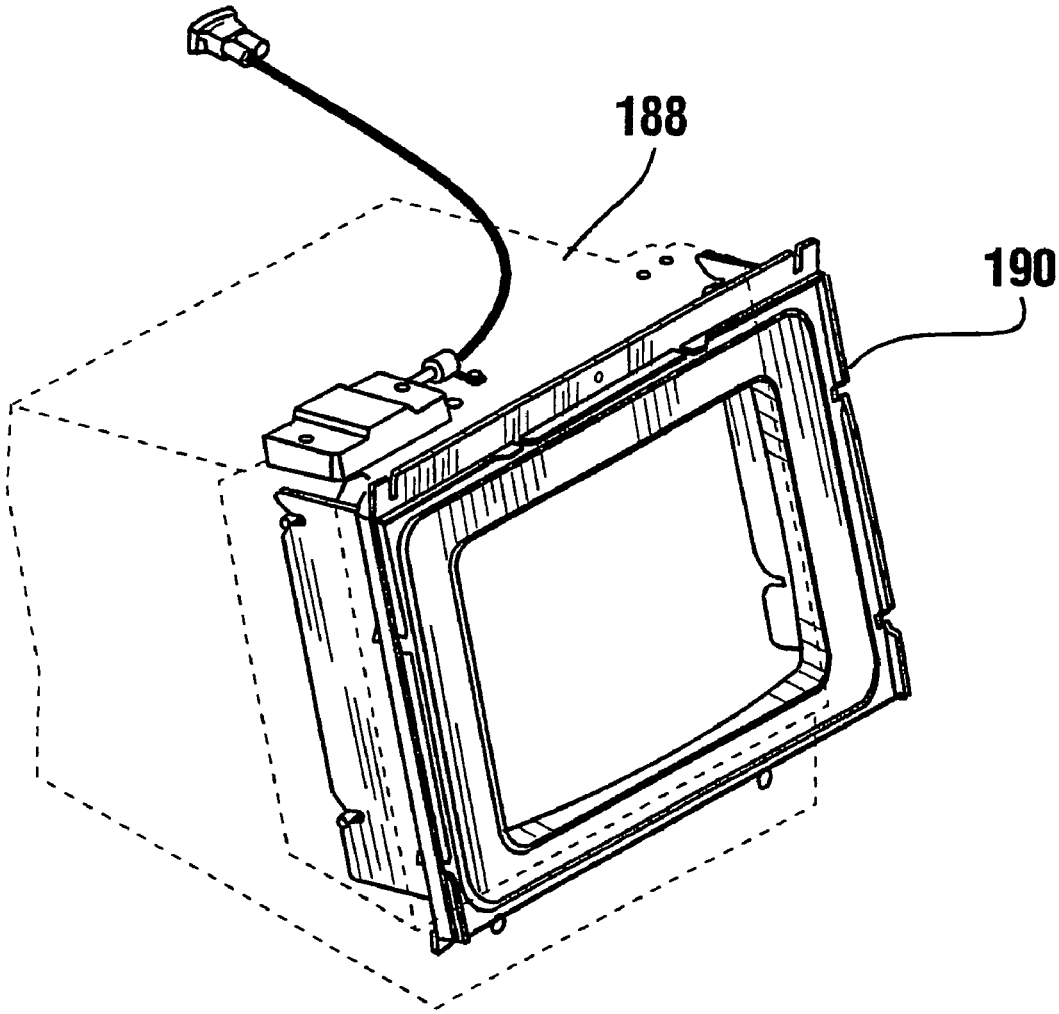
FIG. 23 is a partial phantom isometric view showing the screen surround installed on the monitor.
Figure 24:
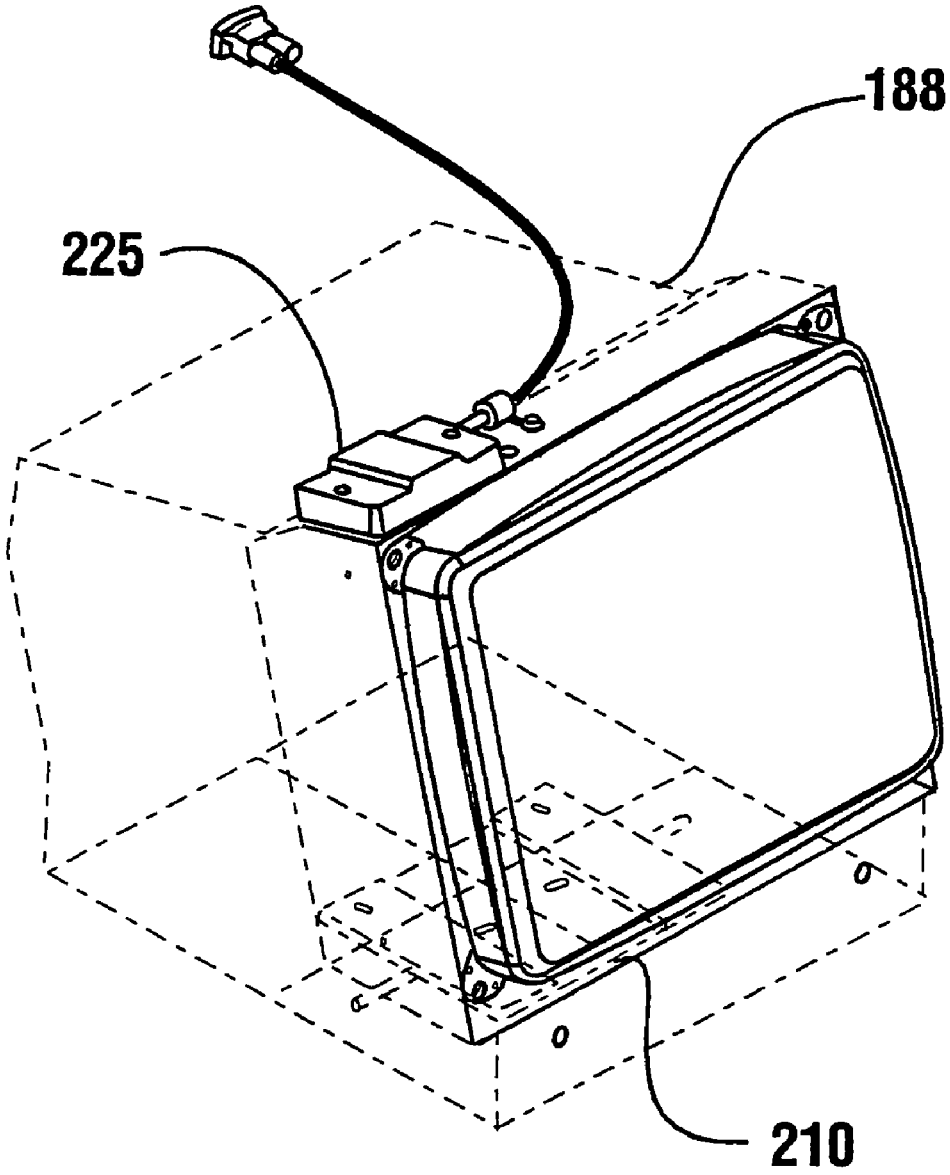
FIG. 24 is a partial phantom view of the monitor shown in position on a bottom mounting plate.
Figure 25:
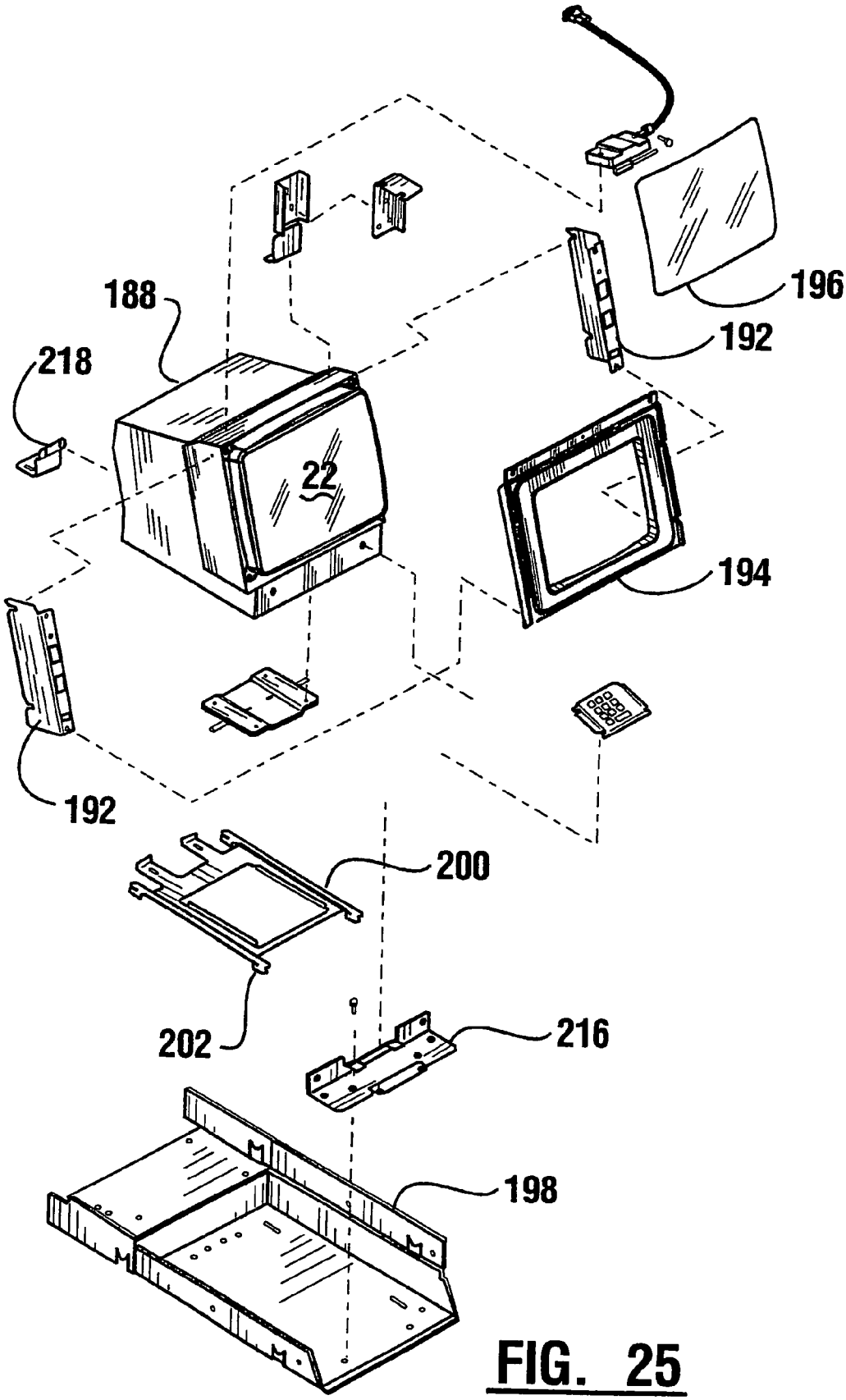
FIG. 25 is an exploded isometric view of the monitor and mounting system associated therewith.

A monitor 188 for installation in the ATM is shown in FIG. 21. The monitor includes the screen 22 which is part of the ATM's graphical user interface with the customer. For purposes of providing a gap-free enclosure between the monitor 188 and the fascia, a monitor surround assembly 190 is installed on the front of the monitor. As best shown in FIG. 25, the monitor surround assembly is comprised of a pair of side pieces 192 which attach to the sides of monitor 188 by fasteners as well as a front plate 194.

The side plates and front plates include slotted openings which enable the adjustable mounting of the monitor surround assembly on the monitor. This facilitates adjustment of the surround assembly to accommodate the adjacent fascia. As shown in FIG. 25, the monitor surround assembly may also include an anti-glare lens 196 which provides for better viewing of the screen 22 as well as for protection of the monitor against vandalism.

Figure 27:
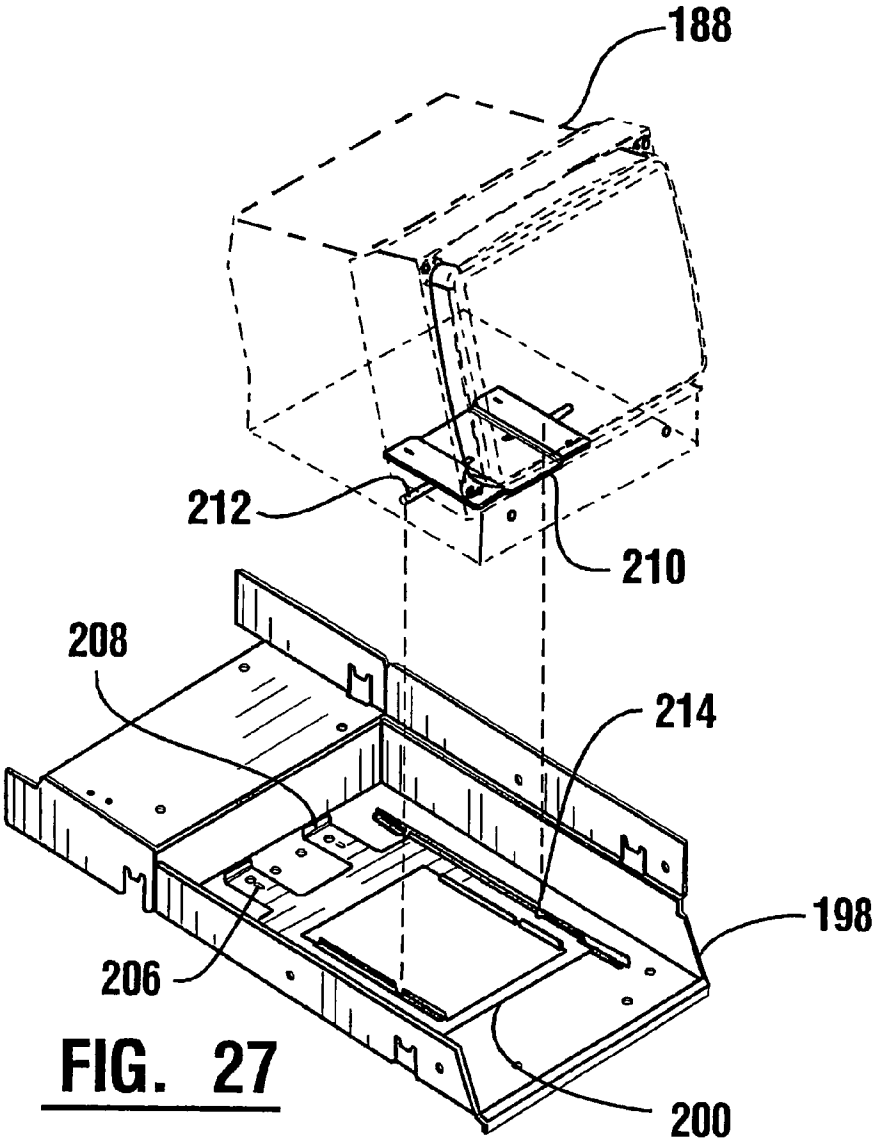
FIG. 27 is an isometric partial phantom view of the bottom tray and swivel bracket assembly of the monitor mounting mechanism.
Figure 26:
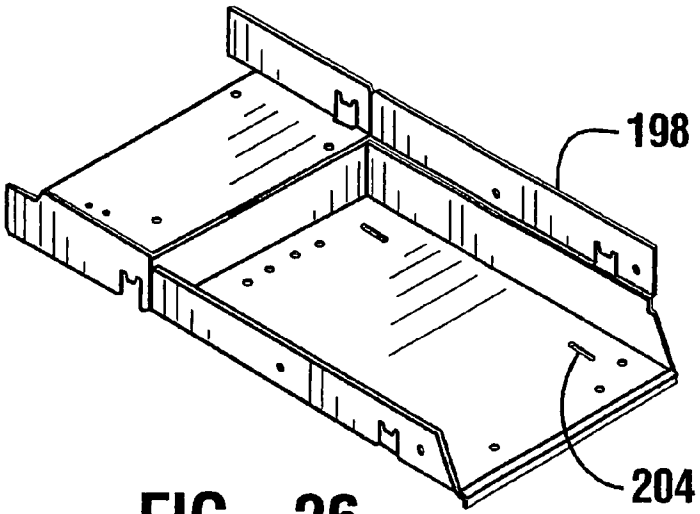
FIG. 26 is an isometric view of the bottom tray of the mounting system shown in FIG. 25.

The exemplary monitor mounting assembly further includes a lower tray 198 as shown in FIGS. 25 and 26. A bottom slide bracket 200 is installed in the front of tray 198. As shown in FIG. 25, the slide bracket includes downward extending projections 202 which ride in slots 204 in the bottom wall of the tray. Slide bracket 202 includes slotted openings 206 for fastening the slide bracket to the tray as well as tabs 208 which guide movement of the slide bracket back and forth. An upper pivot bracket 210 is mounted to the bottom of monitor 188 by fasteners as shown in FIG. 27. The upper pivot bracket 210 includes a shaft 212 extending therethrough. Shaft 212 nests in four slots 214 in the lower slide bracket and enables the upper pivot bracket to pivot therein. As a result, monitor 188 is enabled to be tilted through a range of angles.

Figure 28:
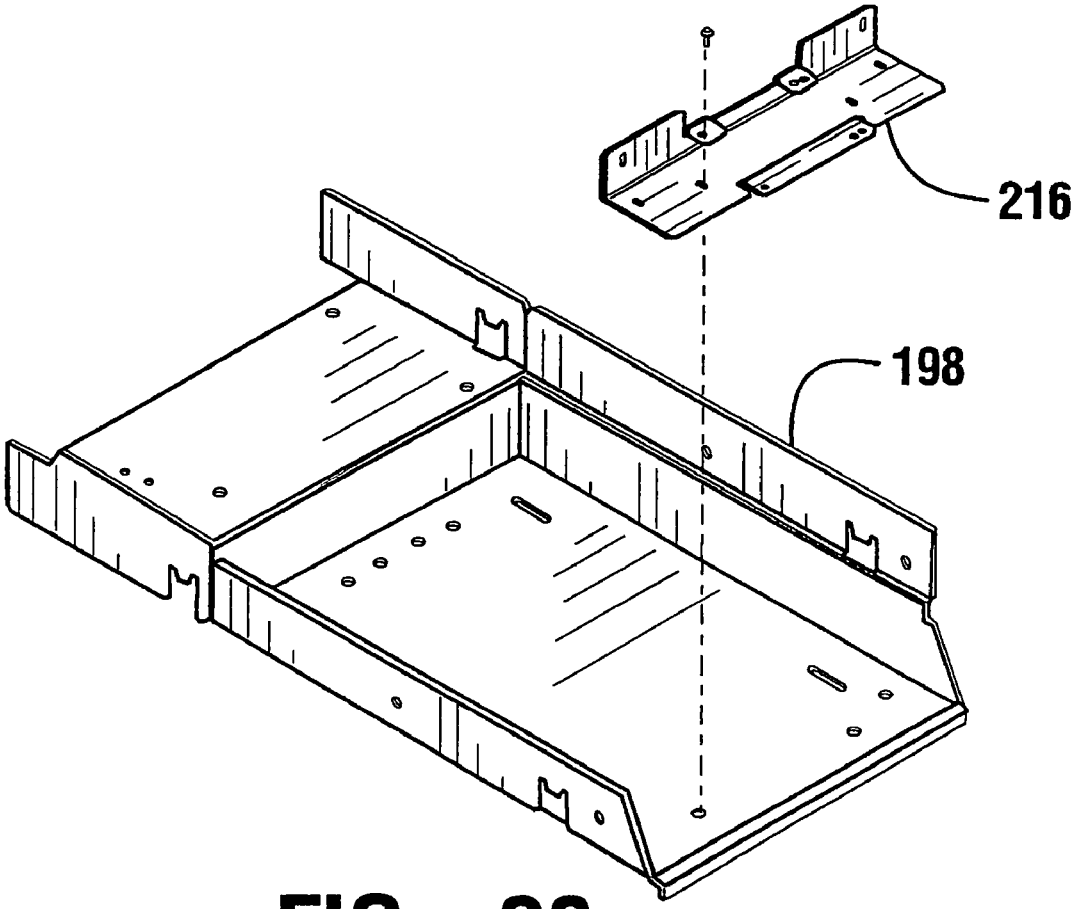
FIG. 28 is an isometric view of the bottom tray and front mounting bracket for mounting the monitor.
Figure 30:
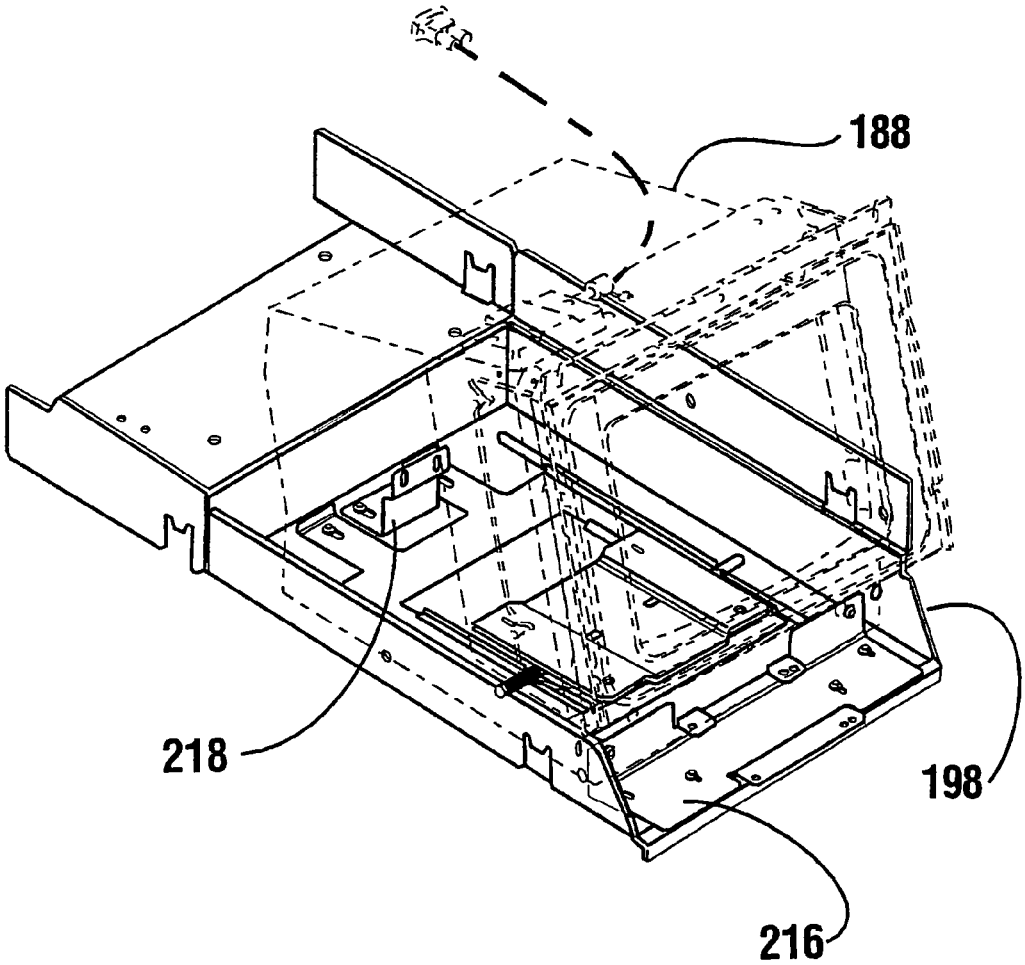
FIG. 30 is an isometric partial phantom view of the monitor mounting assembly.

The monitor mounting assembly further includes a front locking bracket 216 which is best shown in FIG. 28. Front bracket 216 is mounted toward the front edge of tray 198 by fasteners as shown. As best shown in FIG. 30, front bracket 216 includes slotted openings both for the fasteners that attach to tray 198 as well as to the front of monitor 188. As a result, the front bracket is enabled to hold the monitor through the range of tilted positions.

Figure 29:
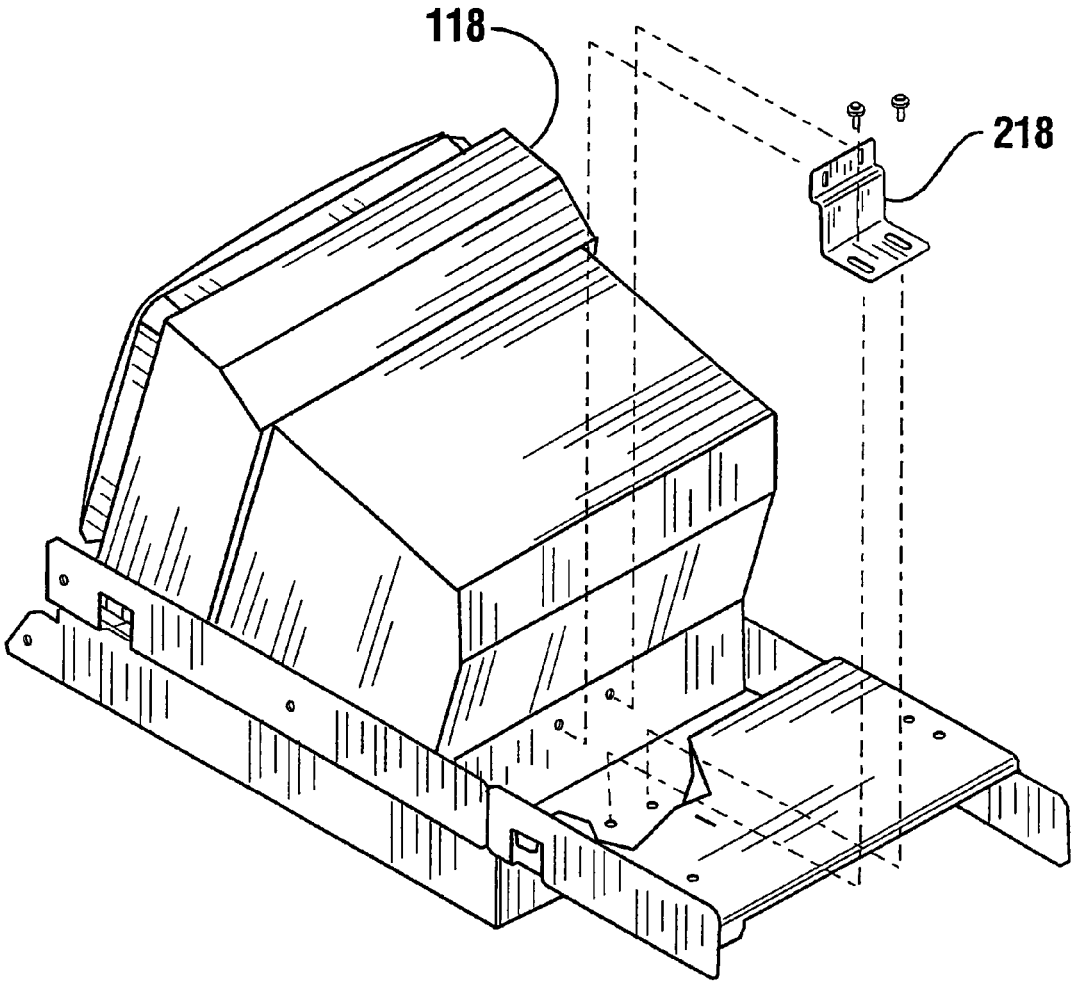
FIG. 29 is a rear isometric view showing the back mounting bracket for the monitor.

The mounting assembly further includes a rear locking bracket 218. As best shown FIG. 29, rear bracket 218 includes a pair of vertical slots for mounting to monitor 118 as well as a pair of horizontally extending slots for mounting bracket 218 to tray 198. This further enables the monitor to be held in a plurality of tilted positions. Monitor 188 includes a cable connector bracket 220 which connects to a cable as shown for providing the signals that drive monitor 188.

The exemplary monitor mounting assembly enables the monitor to be moved forward and backward within tray 198 by movement of tabs 208 on the lower slide bracket 200. Further, monitor 188 may be tilted to the desired angle. By tilting of the upper pivot bracket on the lower slide bracket, fasteners extending through the front bracket 216 and rear bracket 218 may be secured to hold monitor 188 in the desired position. Any gaps between the monitor surround assembly 190 and the fascia of the ATM may be eliminated by adjustment of the monitor surround assembly on the monitor. As a result, monitor 188 may be oriented as desired to provide alignment between the monitor and the fascia.

The tray 198 enables the entire monitor adjustment assembly to be mounted inside the ATM in a manner similar to tray 46 so that the monitor may be pulled out of the enclosure of the ATM for purposes of alignment or servicing. Alternatively, the tray 198 may be fastened securely within the ATM enclosure at the time of ATM assembly.

Alternative embodiments of the ATM may have the capability to use various types of monitors. These may include monitors having different sizes and properties. The exemplary automated banking machine structure which includes the capabilities for having different types of monitors therein is described in U.S. Pat. No. 6,328,206, the disclosure of which is incorporated herein by reference. Of course these approaches are exemplary, and in other embodiments other approaches and features may be used.

Figure 31:
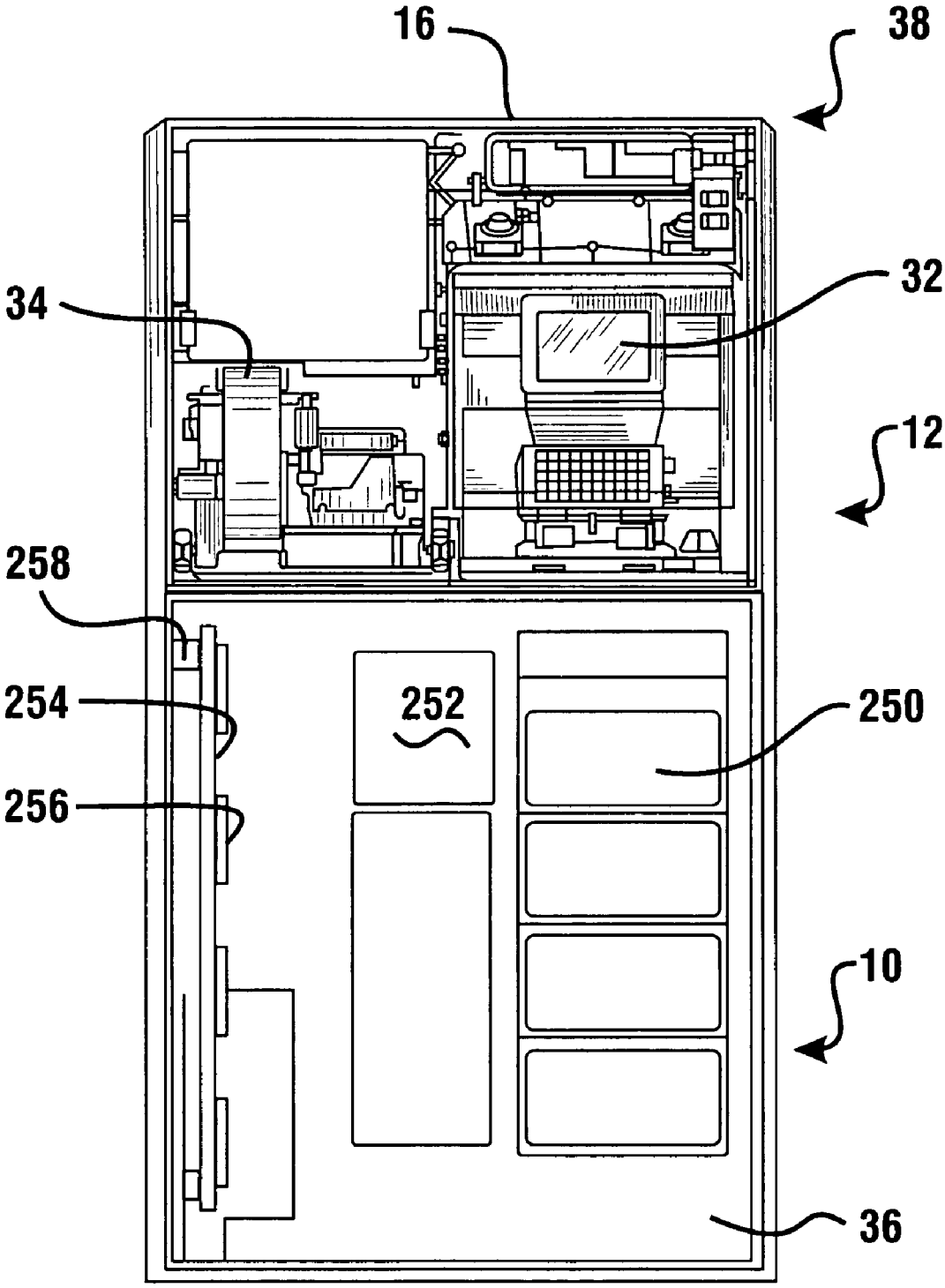
FIG. 31 is a back view of an automated banking machine with the door covering the chest portion removed, and showing an exemplary form of a mounting plate for circuit card assemblies and other electrical items therein.

FIG. 31 shows a rear view of the exemplary ATM 10 with the rear access door removed. Mounted within the chest portion of the enclosure 36 is shown a cash dispenser 250. Cash dispenser device 250 may be one of the types previously discussed that is operative responsive to at least one controller in the machine to cause cash to be dispensed from the machine to users thereof. Chest portion 36 also includes a deposit acceptor 252. Deposit accepting mechanism 252 is operative to hold deposits made by users to the ATM. Of course in other embodiments other types of transaction function devices may be held within the chest portion.

In the exemplary ATM 10, a mounting plate 254 is also positioned in the chest portion. Mounting plate 254 is operative to provide a convenient way for mounting, testing and servicing circuit card assemblies that are used by the ATM in its operation. In the exemplary embodiment, the circuit card assemblies 256 are removably mounted to the mounting plate 254 in a manner later described in detail. The mounting plate 254 is releasably engaged to the housing of the ATM in the chest portion through mounts 258. In the exemplary embodiment, mounts 258 may include releasable fastener type mounts. In alternative embodiments, mounts 258 may include slides or rollout tray supports which are operative to enable a servicer to selectively extend the mounting plate 254 outside the housing. Further in alternative embodiments, the mounting plate 254 may be comprised of several discrete mounting plate segments which may be fixed or movable relative to the housing. Further, although the exemplary mounting plate is shown extending generally vertically and within the chest portion of the housing, in other embodiments mounting plates may be positioned in other orientations and/or be positioned outside the chest portion.

Figure 32:
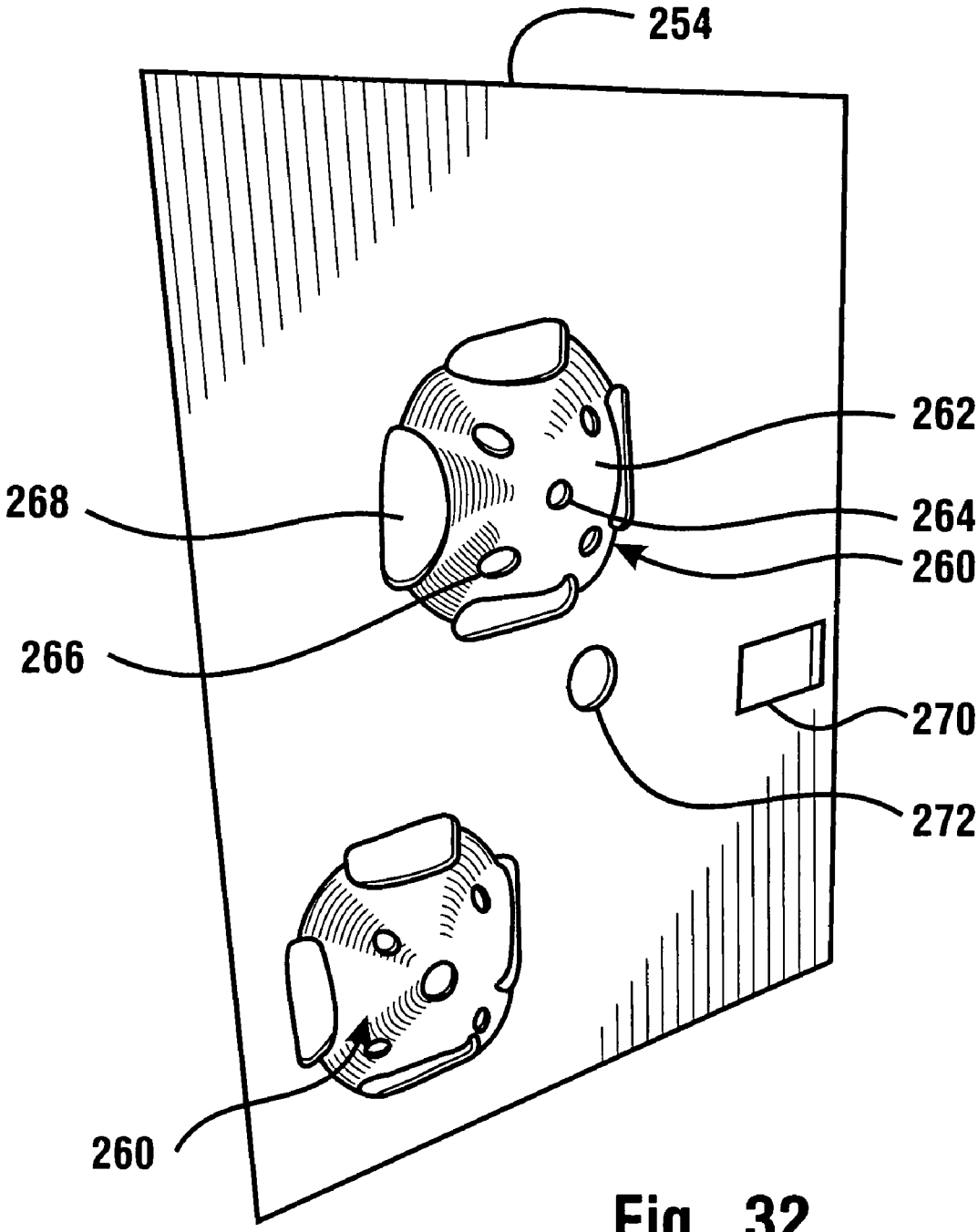
FIG. 32 is an isometric view of a portion of an exemplary mounting plate including the dimples thereon.

FIG. 32 shows a portion of the mounting plate 254. The mounting plate 254 includes a plurality of dimples 260 thereon. As previously discussed, for purposes of this disclosure, dimples are considered to be projecting portions which extent outwardly from a generally planar surface of the mounting plate 254. In the exemplary embodiment the mounting plate comprises metal, and the dimples are formed in the metal through metal forming operations such as by a programmable punch machine. A mounting plate can be made entirely of metal. Of course in alternative embodiments mounting plates can be formed of other materials (e.g., plastic, polymer, fiberglass, resin, or glass, or any combination thereof) and through other processes (e.g., molding). Also, a mounting plate can be made of a combination of metal and one or more other materials.

Figure 33:
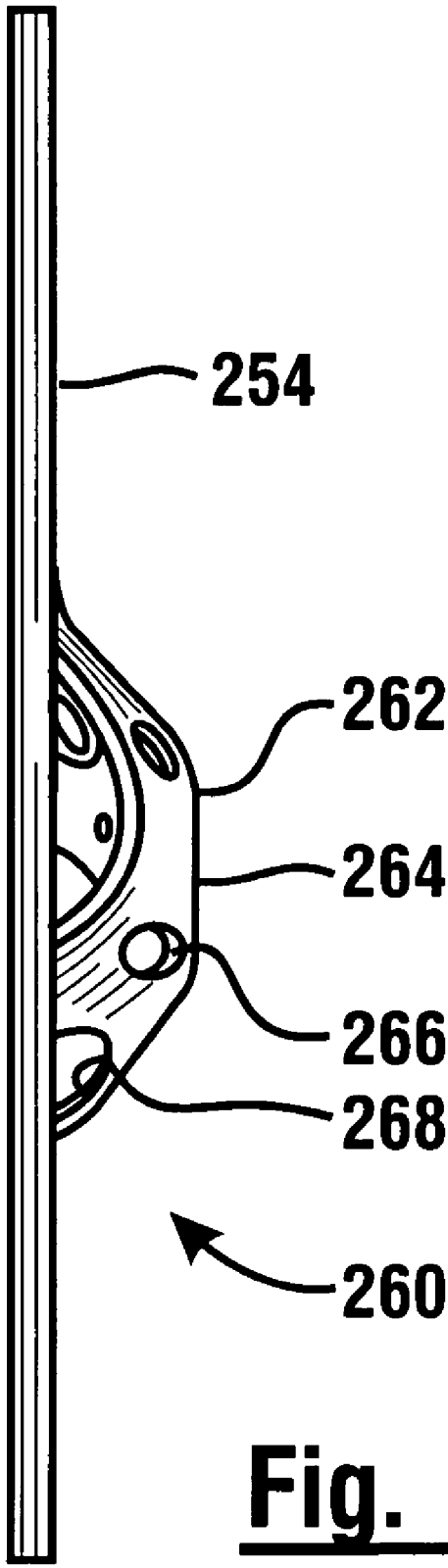
FIG. 33 is a side view of a portion of the mounting plate and an exemplary dimple.

As also represented in FIG. 33, each of the dimples comprises an apex 262. Apex 262 in the exemplary embodiment has a generally flat area that extends the furthest outward from the generally planar surface of the mounting plate. Apex 262 is configured to have circuit card assemblies or other components mounted in supporting, generally abutting, engagement therewith. Apex 262 includes therein an aperture 264. Aperture 264 in an exemplary embodiment comprises an opening for accepting a fastener such as a self-threading fastener such as a screw or bolt. Of course in other embodiments other types of fasteners such as push-through connectors, barbed members, screws, bolt-and-nut combinations, or other items may be used.

As shown in FIGS. 32 and 33, dimples 260 of the exemplary embodiment include vent openings 266 and 268. Vent openings 266 and 268 in the exemplary embodiment facilitate the flow of air through the dimples so as to facilitate air circulation and heat dissipation. In addition, vent openings 266 and 268 also enable extending wires and other items through the mounting plate as may be necessary to install the applicable components. Further, in some exemplary embodiments such as when the mounting plate is formed of steel material, the vent openings also serve to facilitate the deformation of the metal so as to avoid cracking, and may also serve to reduce weight.

As can be appreciated, mounting plate 254 may also include therein other appropriate openings and features to facilitate the engagement of the mounting plate with other structures and devices. This is represented in FIG. 32 by a rectangular opening 270 and a circular opening 272 in the mounting plate. Of course these openings are exemplary of various features that may be included in the mounting plate.

Figure 34:
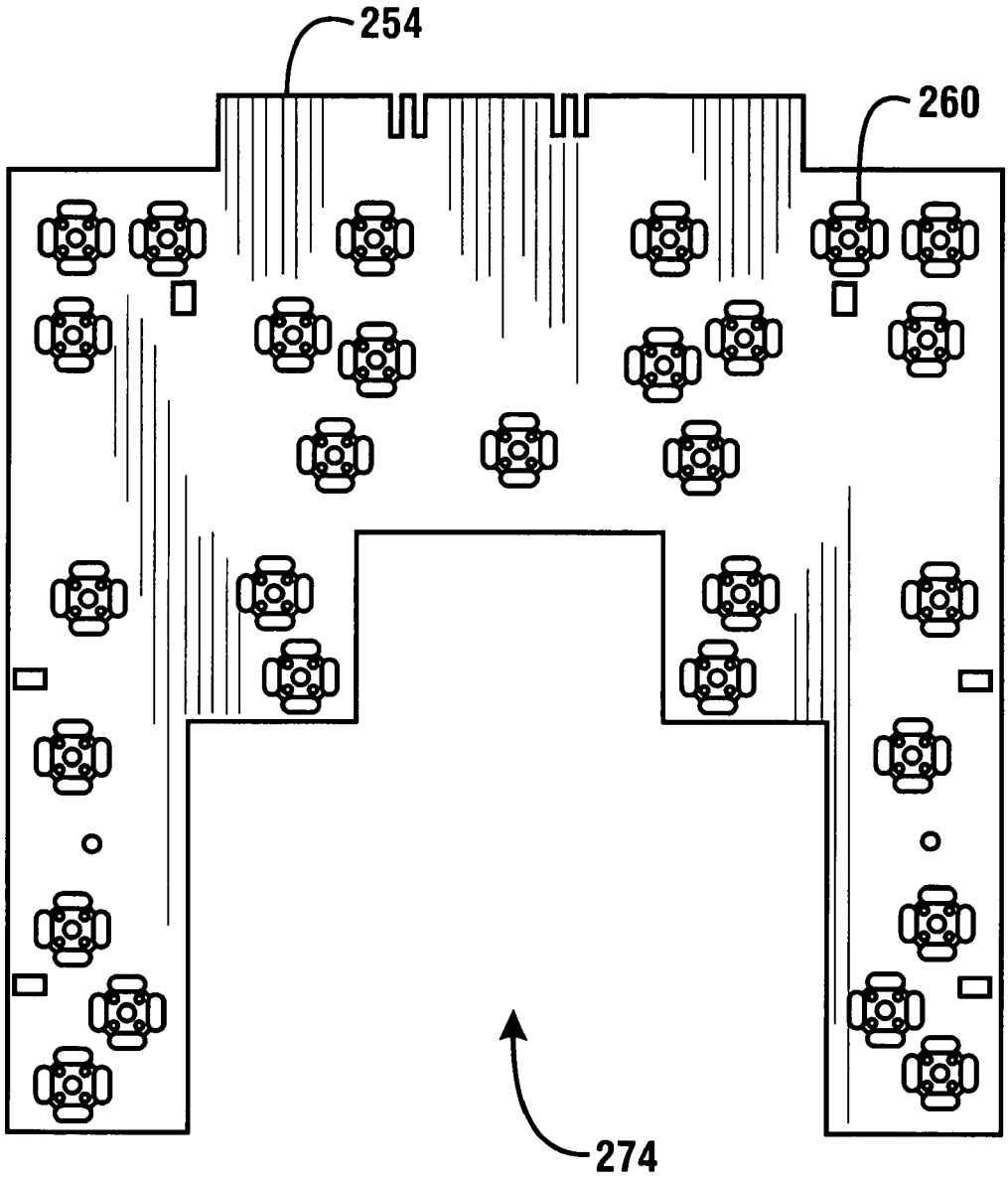
FIG. 34 is an exemplary embodiment of a circuit card assembly mounting plate for use in an exemplary automated banking machine.

FIG. 34 shows exemplary mounting plate 254. The mounting plate 254 includes a plurality of dimples 260. The plurality of dimples are arranged in a pattern that is specific to the arrangement of circuit card assemblies that are to be attached thereto. Also, in the exemplary embodiment the mounting plate 254 includes a cutout area 274. In the exemplary embodiment, the cutout area is sized to have extending therein certain other components of the automated banking machine. It should be noted that in the exemplary embodiment the mounting plate 254 is symmetrical. This may be useful in certain ATMs, as circuit card assemblies may be mounted in a left-hand or right-hand arrangement as is necessary to facilitate mounting within the machine. Further, the symmetrical nature of the mounting plate facilitates the use of the plate in both front-load and rear-load machines. Of course these approaches are exemplary, and in other embodiments other approaches may be used.

In exemplary embodiments, the manufacture and servicing of automated banking machines may be facilitated by producing mounting plates having integrally formed dimples therein arranged so as to provide a mounting surface for a plurality of circuit card assemblies that are used in the operation of the ATM. As previously discussed, in the exemplary embodiment mounting plates have integrally formed dimples that are formed from the material of the mounting plate by cutting and deforming the metal at appropriate locations. As the exemplary mounting plates are identical for a given model of ATM and/or are symmetrical, the form of the mounting plates may be assembled into a stack which includes a plurality of mounting plates. In the stack, the dimples may be arranged in nested relation. This is represented by the portion of the two mounted plates shown in FIG. 36 which include the dimples in nested relation. This feature of the exemplary embodiment enables a plurality of mounting plates to be made and stored conveniently in a stack until they are needed for use. In addition, the ability of the dimples to nest in dimples of adjacent mounting plates facilitates efficiently transporting the mounting plates from the location in which they are made to the point of use where each mounting plate is separated from the stack to be assembled with other banking machine components. Of course these approaches are exemplary, and in other embodiments other approaches may be used.

FIG. 37 shows a portion of an exemplary mounting plate 254. This portion of the mounting plate shows that dimples may extend from either side of the plate in some embodiments. For example, dimples may extend from a first side to facilitate the mounting of circuit card assemblies in engagement therewith. Dimples extending outward from the opposed side of the mounting plate may be used for mounting switches, connectors, circuit card assemblies, or other items as appropriate. In some embodiments dimples extending from the opposed side may be used to facilitate mounting of the mounting plate to stationary or movable mounts within the machine. Of course these approaches are exemplary, and in other embodiments other approaches may be used.

As represented in FIG. 38, when the mounting plates are used in the manufacture of an automated banking machine, circuit card assemblies 256 are placed in supporting connection with the dimples 260. Openings through the circuit card assemblies have a fastener 276 extended therethrough so as to further extend through the dimple aperture 264. In the exemplary embodiment, the fasteners 276 are removable, such as self-threading screws. Of course in other embodiments other types of fasteners may be used. As represented in FIG. 38 the circuit card assemblies 256 are held in engagement with the apex 262 of the dimples by the fasteners 276. Each circuit card assembly 256 is in supporting connection with at least one dimple 260.

FIG. 39 is an exemplary view of an automated banking machine chest portion with a dimpled mounting plate 254 attached thereto. The mounting arrangement 258 includes slide or rollout supports which enable a machine servicer to selectively extend the mounting plate 254 outside the chest. Thus, FIG. 39 shows a mounting plate having circuit card assemblies attached thereto installed in an automated banking machine. As previously discussed, the automated banking machine (e.g., an ATM) can include a cash dispenser.

In some exemplary embodiments provision is made for testing the operation of the circuit card assemblies that are attached to the mounting plate before the mounting plate is installed in the machine. In the exemplary embodiment represented in FIG. 35, a mounting plate 254 is attached through screws or other suitable devices to a wood or other suitable carrier plate 278. In the exemplary embodiment the carrier plate 278 includes a handle portion 280 to facilitate manipulating the carrier plate and transporting it to a desired location.

In the exemplary embodiment, once the mounting plate has been attached to the carrier plate, additional components such as a processor enclosure 282 and power supply 284 may also be attached to the carrier plate through appropriate fasteners. In the exemplary embodiment, the processor enclosure and power supply are mounted such that they extend from the cutout area 274 of the mounting plate. Of course this approach is exemplary of many that may be used.

The circuit card assemblies 256 are then attached to the mounting plate through the dimples in the manner previously discussed. In addition, other components such as switch 286 are also attached to the mounting plate.

Figure 35:
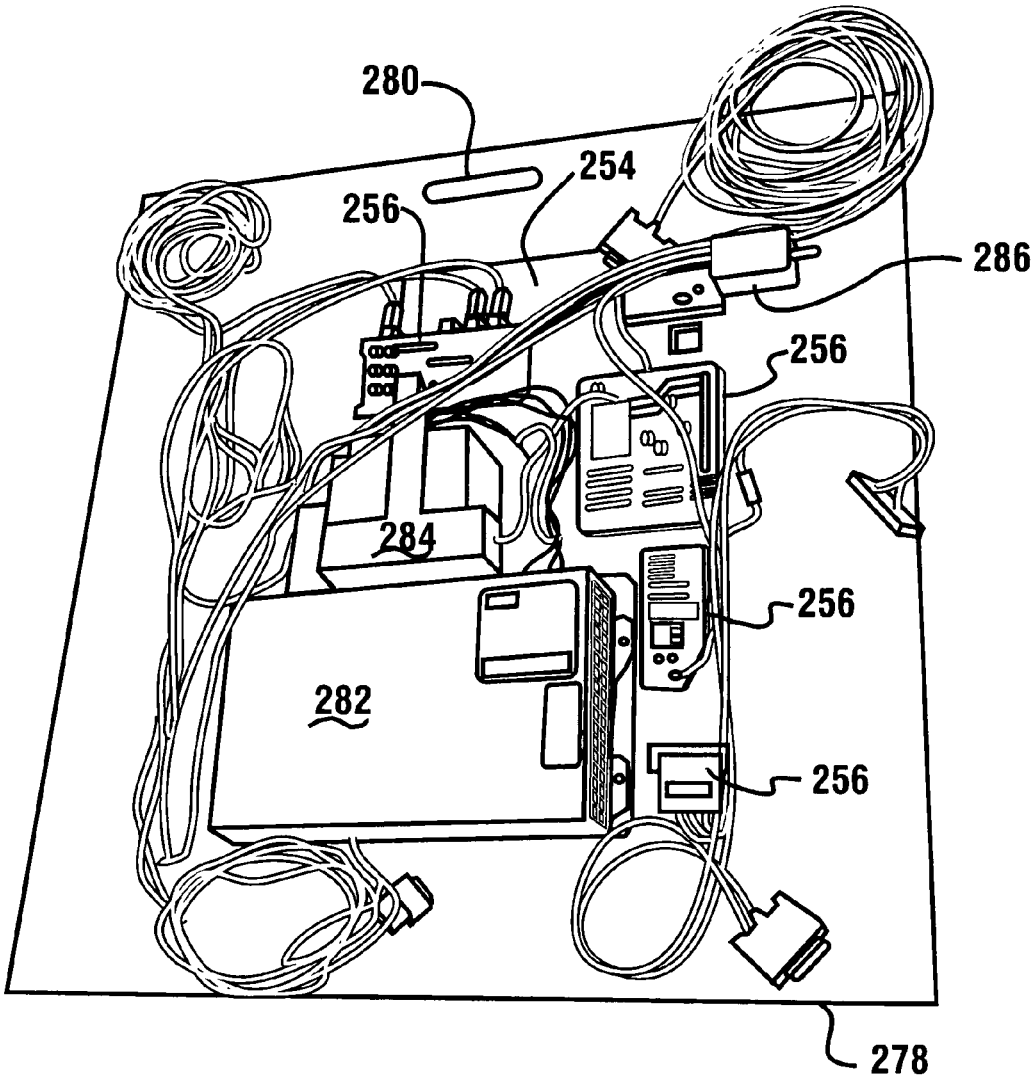
FIG. 35 is a view of the exemplary mounting plate shown in FIG. 34 attached to a fixture with other electrical components for purposes of conducting assembly operations and testing prior to installing the mounting plate in the ATM.

Thereafter, the circuit card assemblies and other items are electrically interconnected through wiring. This is done by attaching to the various electrical connectors on the circuit card assemblies and other items the appropriate wiring harnesses are represented in FIG. 35. Once all the wiring harnesses are appropriately connected, provision may be made in some exemplary embodiments to conduct one or more tests of the operation of the circuit card assemblies and other items that are attached to the carrier plate. This may be done, for example, by connecting the power supply to an appropriate source of electrical power and the wiring harnesses that connect to other components within the machine, to similar devices or simulators of those devices. This enables the circuit card assemblies to communicate with each other and with the other components as appropriate to test them for proper operation. In this way, any malfunctioning components can be identified and replaced before they are installed in the machine. In addition, any adjustments that may be required based on the particular components with which a particular item communicates may also be more readily made. Of course this approach is exemplary, and in other embodiments other approaches may be used.

Once the components attached to the carrier plate 278 have been tested, they may be disengaged therefrom and installed in supporting connection with the housing of the automated banking machine. This may be done in the manner previously discussed by attaching the mounting plate to fixed mounts, slide mounts, roll-out trays or other appropriate mounting. Likewise, the processor enclosure, power supply and other items may be attached in supporting connection with the machine housing through movable or fixed mounts.

After the mounting plate and other components have been mounted in the machine, the wiring harnesses are connected to the other appropriate connectors for purposes of operating the transaction function devices in the machine. Once all the devices have been installed and the appropriate connectors connected, the machine may be operated with the circuit card assemblies on the mounting plate being used in the operation of the machine.

Further, in the event of a malfunction of the machine, the exemplary approach for mounting of the circuit card assemblies to the mounting plate may facilitate diagnosis and replacement of circuit card assemblies. For example, because the mounting plate has the circuit card assemblies separable therefrom, by disconnecting the fasteners a malfunctioning circuit card assembly may be disengaged therefrom and replaced. In addition in some exemplary embodiments, the mounting plate may be removed from the machine so as to facilitate diagnosis and replacement of one or more malfunctioning circuit boards. Further in some embodiments, the mounting plate and other devices may be made movably mounted such that they can be extended outside the machine housing for service and replacement, and then returned to the operative position within the machine so as to continue to be used in operation.

In some exemplary embodiments the mounting plate may be used for mounting other devices that are useful in the operation of the machine. For example, in the exemplary embodiment, the mounting plate may be used for mounting switch 286 which is used to sense whether the chest door is in an open position. In other embodiments the mounting plate may be used for holding devices such as seismic detectors, temperature sensors, alarm devices or other items that are useful in the operation of the automated banking machine.

The exemplary embodiments have advantages in terms of providing compact and serviceable units. The exemplary embodiments further achieve through certain features a construction that may be readily adapted to front load or rear load configuration, as required for a lobby or through-the-wall installation, that facilitates assembly and enables more ready servicing.

Thus, the new automated teller machine of the exemplary embodiments achieve one or more of the above stated objectives, eliminate difficulties encountered in the use of prior devices and systems, solve problems, and attain the desirable results described herein.

Further in the following claims any feature described as a means for performing a function shall be construed as encompassing any means known to those skilled to the art as capable of performing the recited function, and shall not be deemed limited to the particular device, structure or method step described in the foregoing description or mere equivalents thereof.

In the foregoing description certain terms have been used for brevity, clarity and understanding, however no unnecessary limitations are to be implied therefrom because such terms are for descriptive purposes and are intended to be broadly construed. Moreover, the descriptions and illustrations given are by way of examples and the invention is not limited to the exact details shown and described.

Having the features, discoveries and principles of the invention, the manner in which it is constructed and operated, and the advantages and useful results attained, the new and useful structures, devices, elements, arrangements, parts, combinations, systems, equipment, operations and relationships are set forth in the appended claims.

We claim:

1. A method comprising:

(a) producing a mounting plate including a plurality of outwardly projecting dimples extending on at least one side of the mounting plate, wherein each of the plurality of dimples including an aperture extending therein;

(b) attaching a plurality of circuit card assemblies to the mounting plate, wherein each circuit card assembly is attached with at least one removable fastener extending through a dimple aperture, wherein each circuit card assembly is in supporting connection with at least one dimple;

(c) subsequent to (b), installing the mounting plate with the circuit card assemblies attached thereto in an automated banking machine including a cash dispenser.

2. The method according to claim 1 and subsequent to (b) and prior to (c) further comprising:

(d) connecting wiring between at least two of the plurality of circuit card assemblies attached to the mounting plate.

3. The method according to claim 2 and subsequent to (d) and prior to (c) further comprising:

(e) conducting at least one test concerning operation of at least two circuit card assemblies connected by wiring in (d).

4. The method according to claim 3 and further comprising:

(f) disconnecting at least one of the plurality of circuit boards from the mounting plate.

5. The method according to claim 4 and subsequent to (c) and prior to (f) removing the mounting plate and attached circuit card assemblies from the automated banking machine.

6. The method according to claim 1 wherein the mounting plate comprises metal, wherein in (a) the dimples are integrally formed on the mounting plate.

7. The method according to claim 1 wherein in (a) the plurality of dimples extend on two opposed sides of the mounting plate.

8. The method according to claim 1 and further comprising:

(d) operating the cash dispenser, wherein cash is dispensed from the machine.

9. The method according to claim 1 wherein (b) comprises attaching at least one circuit card assembly to the mounting plate with a self-threading fastener extending through a dimple aperture.

10. The method according to claim 1 wherein in (a) at least one dimple includes at least one vent opening therethrough disposed of the aperture.

11. The method according to claim 10 wherein in (a) the aperture of each dimple extends at an apex thereof, and wherein the apex comprises a generally flat area.

12. The method according to claim 1 wherein a plurality of mounting plates are arranged in a stack with dimples of adjacent mounting plates extending in nested relation, and prior to (b) removing the mounting plate from the stack.

13. A method comprising:

(a) attaching at least one circuit card assembly to a mounting plate including a plurality of dimples extending from at least one side thereof by extending at least one fastener through an aperture in an apex of at least one dimple;

(b) using the at least one circuit card assembly in operation of an automated banking machine including a cash dispenser.

14. The method according to claim 13 and prior to (b) further comprising:

(c) subsequent to (a), installing the mounting plate with the at least one circuit card assembly attached thereto in the automated banking machine.

15. The method according to claim 14 and subsequent to (a) and prior to (c) further comprising:

(d) conducting at least one test of the operation of the at least one circuit card assembly.

16. The method according to claim 15 and prior to (d) further comprising:

(f) connecting at least one circuit card assembly attached to the mounting plate through wiring to at least one other circuit card assembly attached to the mounting plate.

17. The method according to claim 14 and prior to (a) further comprising:

storing the mounting plate with a plurality of other mounting plates in a stack, wherein when the plurality of mounting plates are in the stack the dimples of the mounting plates extend in nested relation.

18. A method comprising:

(a) producing a mounting plate including a plurality of integrally formed outwardly projecting dimples, wherein at least one dimple includes air vents spaced from an aperture in an apex thereof;

(b) attaching at least one circuit card assembly to the mounting plate, wherein at least one fastener respectively extends through an aperture of a dimple including air vents;

(c) installing the mounting plate with the at least one circuit card assembly attached thereto in an automated banking machine, wherein the automated banking machine includes a cash dispenser, and wherein the cash dispenser is operative to dispense cash from the automated banking machine.

19. The method according to claim 18 and further comprising:

(d) subsequent to (b) and prior to (c), conducting at least one test of the at least one circuit card assembly attached in (b) while attached to the mounting plate.

* * * * *